US010788279B2

(12) United States Patent
Fischbach et al.

(10) Patent No.: US 10,788,279 B2
(45) Date of Patent: Sep. 29, 2020

(54) CHAMBERING DEVICE FOR AN AUTOMATIC FIREARM, AND AN AUTOMATIC FIREARM EQUIPPED WITH THE CHAMBERING DEVICE

(71) Applicant: Heckler & Koch GmbH, Oberndorf (DE)

(72) Inventors: Wilhelm Fischbach, Deisslingen (DE); Johannes Kopf, Dunningen (DE); Uwe Fleiner, Stuttgart (DE)

(73) Assignee: Heckler & Koch GmbH, Oberndorf (DE)

( * ) Notice: Subject to any disclaimer, the term of this patent is extended or adjusted under 35 U.S.C. 154(b) by 0 days.

(21) Appl. No.: 16/299,917

(22) Filed: Mar. 12, 2019

(65) Prior Publication Data

US 2019/0277589 A1 Sep. 12, 2019

(30) Foreign Application Priority Data

Mar. 12, 2018 (DE) ..... 10 2018 001 984

(51) Int. Cl.
*F41A 3/72* (2006.01)
*F41A 19/34* (2006.01)

(52) U.S. Cl.
CPC ..... *F41A 3/72* (2013.01); *F41A 19/34* (2013.01)

(58) Field of Classification Search
CPC .... F41A 3/72; F41A 3/00; F41A 19/34; F41A 35/06; F41A 7/02; F41A 11/00
(Continued)

(56) References Cited

U.S. PATENT DOCUMENTS 2,882,635 A * 4/1959 Hill ..... F41A 17/38 42/17
3,198,076 A * 8/1965 Stoner ..... F41C 33/08 89/128

(Continued)

FOREIGN PATENT DOCUMENTS

EP 0 207 058 12/1986
EP 0 489 024 6/1992

(Continued)

OTHER PUBLICATIONS

German Patent Office, "Office Action", issued in connection with German Patent Application No. 10 2018 001 984.6, dated Dec. 7, 2018, with English Translation, 16 pages.

(Continued)

*Primary Examiner* — Michael D David
(74) *Attorney, Agent, or Firm* — Hanley, Flight & Zimmerman, LLC

(57) ABSTRACT

The invention relates to a chambering device (1) for chambering rounds in an automatic firearm, which has a breechblock (119, 172) that can move longitudinally in a receiver (3), comprising: a loading lever (13, 13'), comprising a loading lever handle (15) coupled to a loading lever retainer (17), and a loading lever housing (59, 59'), which can move longitudinally in the receiver (3). The chambering device is characterized in that the loading lever handle (15) can be pivoted from a standby position to an actuation position and back in the loading lever retainer (17), and the loading lever retainer (17) can be mounted in or on the left or right side the loading lever housing (59, 59') and can be removed therefrom without tools. The invention also relates to an automatic firearm equipped with such a chambering device (1).

21 Claims, 27 Drawing Sheets

(58) Field of Classification Search
USPC ..... 89/1.4, 181, 1.42; 42/14, 16
See application file for complete search history.

(56) References Cited

U.S. PATENT DOCUMENTS

| | | | | |
|---|---|---|---|---|
| 3,255,667 | A | 6/1966 | Walther | |
| 3,675,534 | A * | 7/1972 | Beretta | F41G 1/16 89/185 |
| 3,686,998 | A | 8/1972 | Seifried | |
| 3,847,054 | A * | 11/1974 | Ruger | F41A 19/02 89/129.02 |
| 3,960,053 | A * | 6/1976 | Conley | F41A 3/70 89/149 |
| 4,014,247 | A * | 3/1977 | Tollinger | F41A 9/18 89/191.02 |
| 4,052,926 | A * | 10/1977 | Tollinger | F41A 3/72 89/1.4 |
| 4,103,586 | A * | 8/1978 | Tollinger | F41A 9/18 89/144 |
| 4,163,334 | A * | 8/1979 | Tollinger | F41A 15/14 42/25 |
| 4,398,448 | A * | 8/1983 | LaFever | F41A 3/26 89/185 |
| 4,467,698 | A * | 8/1984 | Perrine | F41A 3/50 42/25 |
| 4,505,182 | A * | 3/1985 | Sullivan | F41A 3/72 89/132 |
| 4,553,469 | A * | 11/1985 | Atchisson | F41A 3/46 42/25 |
| 4,654,993 | A * | 4/1987 | Atchisson | F41A 3/72 42/71.01 |
| 4,693,170 | A * | 9/1987 | Atchisson | F41A 3/72 89/149 |
| 4,702,144 | A | 10/1987 | Zedrosser | |
| 4,703,826 | A * | 11/1987 | Byron | F41A 5/24 89/188 |
| 4,766,800 | A * | 8/1988 | Miller | F41A 9/77 89/33.02 |
| 4,893,547 | A * | 1/1990 | Atchisson | F41A 3/46 89/187.01 |
| 5,214,233 | A | 5/1993 | Weldle et al. | |
| 5,700,967 | A * | 12/1997 | Guhring | F41A 3/72 89/1.42 |
| 5,821,445 | A * | 10/1998 | Guhring | F41A 3/72 89/1.42 |
| 6,257,114 | B1 | 7/2001 | Murello | |
| 6,481,145 | B2 * | 11/2002 | Weichert | F41C 27/06 42/105 |
| 6,634,274 | B1 * | 10/2003 | Herring | F41A 5/26 89/191.01 |
| 6,782,791 | B2 * | 8/2004 | Moore | F41A 3/22 89/1.4 |
| 7,219,463 | B2 | 5/2007 | Wossner | |
| 7,231,861 | B1 * | 6/2007 | Gauny | F41A 3/72 42/16 |
| 7,661,219 | B1 * | 2/2010 | Knight, Jr. | F41A 35/06 42/70.02 |
| 7,798,045 | B1 | 9/2010 | Fitzpatrick et al. | |
| 7,849,777 | B1 | 12/2010 | Zedrosser | |
| 8,156,854 | B2 | 4/2012 | Brown | |
| 8,307,747 | B2 | 11/2012 | Fitzpatrick et al. | |
| 8,539,871 | B1 | 9/2013 | Burt et al. | |
| 8,561,517 | B2 | 10/2013 | Brown | |
| 9,109,848 | B2 | 8/2015 | Brown | |
| 10,533,815 | B1 * | 1/2020 | Chang | F41A 3/20 |
| 2002/0046642 | A1 | 4/2002 | Murello | |
| 2007/0033851 | A1 * | 2/2007 | Hochstrate | F41A 15/00 42/75.01 |
| 2007/0199435 | A1 * | 8/2007 | Hochstrate | F41G 11/003 89/191.02 |
| 2009/0064556 | A1 | 3/2009 | Fluhr et al. | |
| 2014/0345444 | A1 * | 11/2014 | Hillman | F41A 7/02 89/1.4 |
| 2017/0191773 | A1 | 7/2017 | Oz et al. | |
| 2018/0266779 | A1 * | 9/2018 | Reynolds | F41A 3/72 |
| 2019/0277588 | A1 * | 9/2019 | Amar | F41G 11/003 |
| 2020/0096267 | A1 * | 3/2020 | Horst | F41A 3/42 |

FOREIGN PATENT DOCUMENTS

| | | |
|---|---|---|
| EP | 2 045 561 | 4/2009 |
| FR | 1349766 | 1/1964 |
| JE | 1 208 221 | 12/1965 |
| JE | 197 47 576 | 4/1999 |
| JE | 199 03 321 | 8/2000 |
| JE | 101 22 345 | 10/2002 |
| JE | 10 2006 006 034 | 10/2007 |
| WO | 2008140833 | 11/2008 |
| WO | 2017186195 | 11/2017 |

OTHER PUBLICATIONS

European Patent Office, Partial European Search Report, issued in connection with European Patent Application No. 19174195.8, dated May 26, 2020, with English machine translation, 34 pages.

* cited by examiner 13
50
46
54
42
47
57
44
47
44
34
47
46
23
43
22
39
15
31
29
15
19
21
21

50
99
103
101
103
95
103
87
90
94
75
74
74
104
94
105
107
70
74
77
73

138
55
45
137
54

119
125
111
59'

119
II
100

14
43
45
I
I
45
105
106
108
59
111
40
115
II 119
14
117
125

51
45
43
54
124
45
138
23
55
24
125
54
111
59'
115

113'
114
115
87
52
127
129
125
138
64'
136
133
141
33
34
51
123
124
145
14
143
139
15

I
II
17
20
43
45
49
15
59'
104
106
105
13
44
46
47
55
53
57
59
87
89
95
99
123
125
133
135
145
147
154
158
124

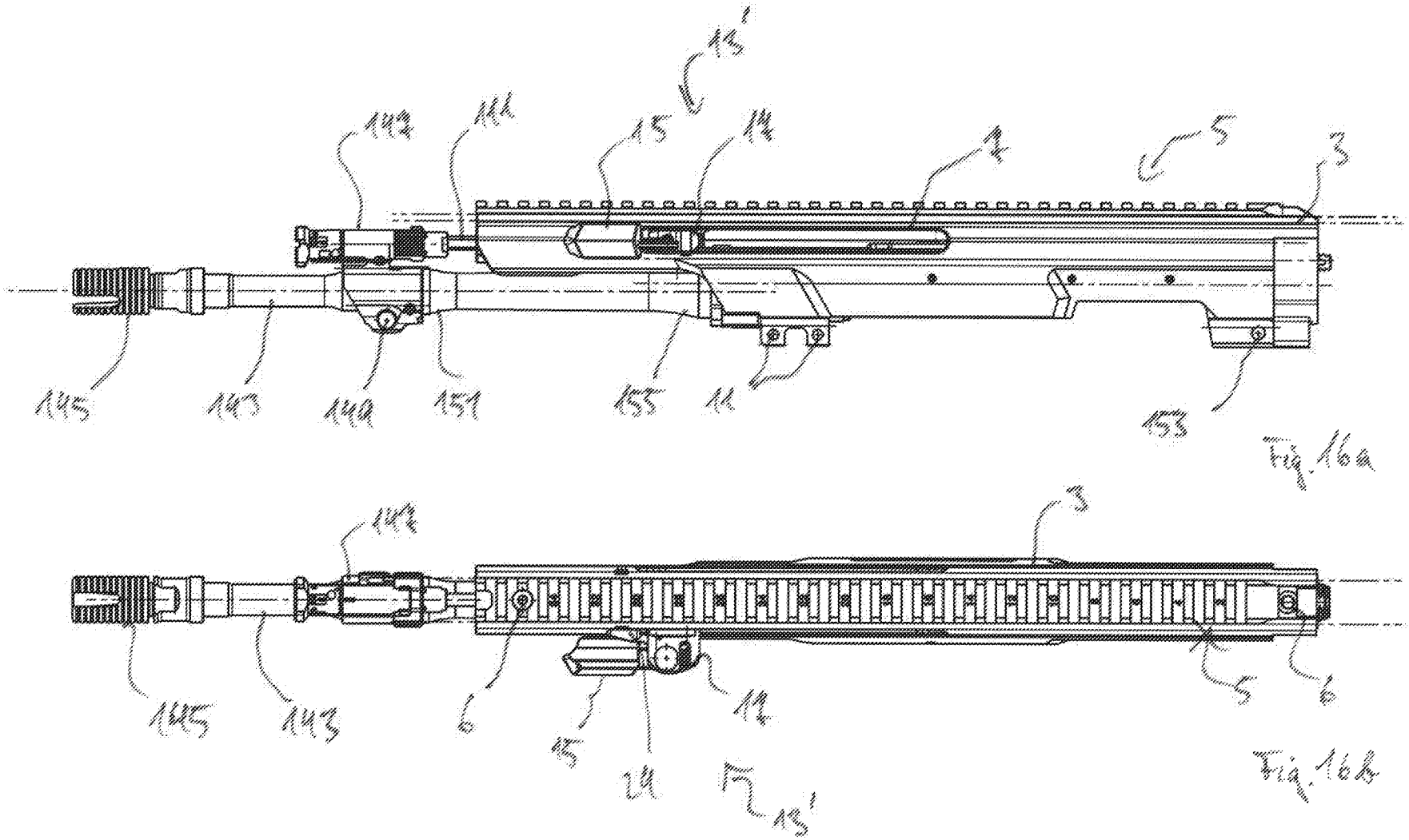
Fig. 16a
Fig. 16b
2
5
6
7
14
15
15'
14'
14a
14b
14c
14d
14e
14f
14g
14h
14i
14j
14k
14l
14m
14n
14o
14p
14q
14r
14s
14t
14u
14v
14w
14x
14y
14z
14aa
14bb
14cc
14dd
14ee
14ff
14gg
14hh
14ii
14jj
14kk
14ll
14mm
14nn
14oo
14pp
14qq
14rr
14ss
14tt
14uu
14vv
14ww
14xx
14yy
14zz
14aaa
14bbb
14ccc
14ddd
14eee
14fff
14ggg
14hhh
14iii
14jjj
14kkk
14lll
14mmm
14nnn
14ooo
14ppp
14qqq
14rrr
14sss
14ttt
14uuu
14vvv
14www
14xxx
14yyy
14zzz
14aaaa
14bbbb
14cccc
14dddd
14eeee
14ffff
14gggg
14hhhh
14iiii
14jjjj
14kkkk
14llll
14mmmm
14nnnn
14oooo
14pppp
14qqqq
14rrrr
14ssss
14tttt
14uuuu
14vvvv
14wwww
14xxxx
14yyyy
14zzzz
14aaaaa
14bbbbb
14ccccc
14ddddd
14eeeee
14fffff
14ggggg
14hhhhh
14iiiii
14jjjjj
14kkkkk
14lllll
14mmmmm
14nnnnn
14ooooo
14ppppp
14qqqqq
14rrrrr
14sssss
14ttttt
14uuuuu
14vvvvv
14wwwww
14xxxxx
14yyyyy
14zzzzz
14aaaaaa
14bbbbbb
14cccccc
14dddddd
14eeeeee
14ffffff
14gggggg
14hhhhhh
14iiiiii
14jjjjjj
14kkkkkk
14llllll
14mmmmmm
14nnnnnn
14oooooo
14pppppp
14qqqqqq
14rrrrrr
14ssssss
14tttttt
14uuuuuu
14vvvvvv
14wwwwww
14xxxxxx
14yyyyyy
14zzzzzz
14aaaaaaa
14bbbbbbb
14ccccccc
14dddddddd
14eeeeeeee
14ffffffff
14gggggggg
14hhhhhhhh
14iiiiiiii
14jjjjjjjj
14kkkkkkkk
14llllllll
14mmmmmmmm
14nnnnnnnn
14oooooooo
14pppppppp
14qqqqqqqq
14rrrrrrrr
14ssssssss
14tttttttt
14uuuuuuuu
14vvvvvvvv
14wwwwwwww
14xxxxxxxx
14yyyyyyyy
14zzzzzzzz
14aaaaaaaa
14bbbbbbbb
14cccccccc
14dddddddd
14eeeeeeee
14ffffffff
14gggggggg
14hhhhhhhh
14iiiiiiii
14jjjjjjjj
14kkkkkkkk
14llllllll
14mmmmmmmm
14nnnnnnnn
14oooooooo
14pppppppp
14qqqqqqqq
14rrrrrrrr
14ssssssss
14tttttttt
14uuuuuuuu
14vvvvvvvv
14wwwwwwww
14xxxxxxxx
14yyyyyyyy
14zzzzzzzz 1
13
17
15
59
111
145
147
143
155
157
158
159
161
163
164
165
167
169
171

153
3
15
14
4
11
12
155
5
151
144
146
143
145
6
E
13
3
14
15
12
6
151
144
143
145

164
165
167
171
158
157
152
14
14a
59
15
10c
14d
1
144
145
143
146
10b
59'
17

CHAMBERING DEVICE FOR AN AUTOMATIC FIREARM, AND AN AUTOMATIC FIREARM EQUIPPED WITH THE CHAMBERING DEVICE

FIELD OF THE INVENTION

The present invention relates to a chambering device for an automatic firearm according to the preamble of claim 1.

The invention also relates to an automatic firearm equipped with such a chambering device.

In this document, position terms such as "up," "down," "front," and "rear," etc. relate to an automatic firearm in which the bore axis is horizontal, and rounds are fired toward the front, away from the shooter.

A chambering device chambers rounds in an automatic firearm, using a loading lever to ready it for firing. The functional sequence in firing and automatically reloading an automatic firearm can be broken down as follows:

There is a breechblock assembly in the receiver that can move longitudinally therein for firing shots, extracting a spent cartridge shell, and reloading. For firing a shot, the breechblock assembly, in particular the breechblock head, guides the uppermost cartridge from the magazine into a chamber in the barrel in the known manner. When a trigger mechanism is actuated, a firing pin strikes the base of the cartridge and ignites a charge, such that a projectile is shot out of the cartridge shell through the barrel. When the projectile passes through the barrel, the propellant in a gas operated chambering device released during the firing process is diverted into a gas discharge. The diverted propellant is used in the known manner to return the breechblock assembly. The propellant drives the breechblock assembly back toward the stock at a high speed via the discharge and a gas piston rod coupled thereto.

There is an extractor on the breechblock head that grips the edge of the cartridge at the base, and pulls it out of the chamber as the breechblock assembly returns. An ejector then pushes the shell out of the receiver in the known manner, through a cartridge ejection window. As the breechblock assembly returns, it slides over the magazine toward the stock. As it subsequently moves forward, the breechblock head again pulls the uppermost cartridge from the magazine, and places it in the chamber, and the cycle is repeated. Alternatively, a recoil loading mechanism can be used in the known manner for this cycle.

For chambering a round, the upper surfaces of the magazine rear wall and front wall each have a recess extending to a certain length on their upper ends. The side walls of a magazine are extended upward, and form so-called magazine lips, which prevent cartridges from falling out of the magazine. A spring in the magazine forces the cartridge feed upward in the magazine housing, thus pushing the cartridges upward to the magazine lips.

With so-called open breechblock automatic firearms, the breechblock (breechblock carrier and breechblock head) are in a forward position prior to firing, i.e. the breechblock head is locked in place in the chamber. When a first or new magazine is inserted in the automatic firearm, the chambering of rounds described above is then carried out.

With a so-called closed breechblock, the breechblock can be brought to a rear position by means of the loading lever, where it is held in place by the triggering mechanism.

Known chambering devices are often attached to the breechblock, and the breechblock can be moved backward, thus toward the stock, by means of the loading lever, such that the breechblock is moved backward over the magazine, counter to the force of the recoil spring. As the breechblock subsequently moves forward, the breechblock head takes the uppermost cartridge from a magazine and pushes it forward into the chamber.

A chambering device lever permanently coupled to the breechblock is provided, by way of example, in the known G36 by the applicant, as well as in the known SA 80. Such a loading lever is also known as a conjoint movement loading lever, because it moves back and forth along with the breechblock carrier that it is coupled to. When the loading lever protrudes from the firearm, it can injure the shooter. When the protruding lever collides with an obstruction, this can obstruct chambering. Such a fixed assembly on the breechblock is known presently in both military as well as civilian automatic firearms.

Non-conjoint movement chambering devices are also known from the AR15 variations, e.g. the HK 416/417 by the same applicant. It is also known that the loading lever can be mounted on and removed from the chambering device without tools.

Chambering devices had already been developed before the First World War, in which the chambering device was decoupled from the breechblock after chambering a round. Because of this decoupling, it was disadvantageously impossible to close the breechblock with the loading lever if it did not close properly.

In general, a number of different types of chambering devices are known for automatic firearms, which may also contain a loading lever, which is located on either the right or left side of the firearm.

By way of example, a non-conjoint movement slide, which is attached to one side of the firearm, and can only be operated from one side, is known from DE 101 22 345 C1 by the same applicant, in particular for the M64, by means of which the breechblock is tensioned in place by a closing spring. There is an oblong slot in the receiver with a clamping track, in which the slide is guided and can be secured in place.

A chambering device, e.g. for the HK416 is also known from DE 10 2006 006 034 B3 by the same applicant, in which the loading lever can be operated ambidextrously via two handles. Actuation of one of the handles automatically releases the safety for the second handle, in order to chamber rounds.

A chambering device for an automatic handgun, in particular the known G36, with a pivoting and latching chambering device is also known from EP 0 489 024 B1 by the same applicant. This is mounted directly, or via an intermediate component, on the breechblock, and can be pivoted away from the receiver on both sides of the longitudinal axis of the breechblock.

Restrictions for military weapons have increased, e.g. regarding ambient temperature, weapon temperature, contaminants, sustained firing, etc. As a result, in certain circumstances, a cartridge may not be fully chambered, or some other loading obstruction may arise. If there is a loading obstruction, the breechblock system may not be able to be closed properly without additional manipulation, such that the shooter may be at risk of injury. Although these obstructions are extremely rare, a military weapon should be as free of obstructions as possible. With such a chambering device, the breechblock can often be operated manually, thus eliminating any chambering obstructions.

A chambering device with a non-conjoint movement loading lever is known from U.S. Pat. No. 7,798,045 B1, wherein the loading lever is provided with handles projecting from the left and right sides. This cannot be disassembled without tools, and also cannot be operated ambidextrously. The chambering device comprises a slide with a hook on the end facing the breechblock carrier, which engages in a corresponding recess on the breechblock carrier, in order to guide it forward, toward the chamber, functioning as a closing aid.

Chambering devices are known from U.S. Pat. No. 9,109,848 B2, 8,156,854 B2 and 8,561,517 B2, requiring tools for mounting it on either the left or right side. The automatic firearms disclosed therein comprise a receiver and a hand guard attached thereto, wherein the chambering device is incorporated in the hand guard. The loading lever can be pivoted between a standby position and an actuation position, wherein it engages with a hole in the gas piston rod when in the actuation position as well as when functioning as a closing aid. The chambering device thus does not act directly on the breechblock carrier. In an alternative design, the chambering device is provided with actuation handles on both sides.

U.S. Pat. No. 8,307,747 B2 discloses another non-conjoint movement chambering device with a chambering slide that has a spring loaded catch-lug that engages with the breechblock carrier. The chambering device lever extends rigidly from the side of the firearm. In its function as a closing aid, the catch-lug engages in the breechblock carrier and pushes it forward. U.S. Pat. No. 8,539,871 B1 discloses a similar chambering device.

FR 1,349,766 and the parallel German patent DE 1 208 221 disclose a chambering device with a non-conjoint movement loading slide, which can be coupled directly to the breechblock carrier via a locking pin. The chambering device is located on top of the firearm, comprises a spring loaded central slide handle, that acts either in a purely spring loaded manner via a threaded connection or via a pivoting lever on a locking element, and moves it from a standby position to its operating position, in which the slide can be coupled directly to the breechblock carrier. This chambering device cannot be switched between right-hand and left-hand operation without tools.

Furthermore, DE 199 03 321 A1 and the parallel US 2002/0046642 by the same applicant disclose a chambering device for a handgun. The loading lever can be switched without tools, is mounted directly in the breechblock, and is thus configured for conjoint movement. The loading lever cannot pivot, and therefore extends laterally from the firearm.

EP 0 207 058 B1 discloses a non-conjoint movement, one-sided chambering device with a loading lever that cannot be switched, and can be pivoted laterally. When chambering rounds, the loading lever acts on the end of a longitudinal rod in the breechblock via a slider. When functioning as a closing aid, the loading lever likewise engages with the longitudinal rod via the slider.

Lastly, U.S. Pat. No. 3,686,998 discloses a pivotal loading lever, which does not move conjointly while chambering a round. A slider acts directly on the breechblock. When used as a closing aid, the pivotal loading lever latches onto a loading lever extension via an oblong hole on its axle and a hook provided thereon. It cannot be disassembled without tools.

OBJECT OF THE INVENTION

With this background, the object of the invention is to create an alternative, structurally simple and functionally reliable chambering device for chambering rounds in an automatic firearm.

This object is achieved by the respective subject matter of the independent claims 1 and 19.

The chambering device for an automatic firearm specified in the introduction is also distinguished in that the loading lever handle can be pivoted from a standby position to an actuation position and back in the loading lever retainer, and the loading lever retainer can be mounted in and removed from the loading lever housing without tools, on either the left or right side.

The automatic firearm according to claim 19 is characterized in that it is equipped with such a chambering device.

The loading lever retainer can be selectively mounted in and removed from the loading lever housing on the left or right side. In particular because it can be mounted and removed without tools, an ambidextrous chambering device can be obtained with structurally simple means, which can be adapted to the ergonomics of the shooter, and thus to a left or right handed operator. The ambidextrousness is currently a frequently demanded criteria in official requirements.

Furthermore, the chambering device, in particular the loading lever can be positioned optimally in relation to the loading lever housing from an ergonomic perspective, such that the aiming of the automatic firearm can be easily maintained while chambering rounds, and the firearm can also be operated from a prone position without raising the body signature. Advantageously, the automatic firearm can also be loaded with the safety on, thus ensuring that the firearm will not be misfired.

In a structurally simple design, the loading lever handle can be pivoted over a bearing axle between a standby position and an actuation position in the chambering device. In a simple design, the loading lever axle can be in the form of a pin.

The loading lever handle can have a profiled surface, in order to improve its grip, in particular in difficult conditions and/or with gloves. The loading lever handle can also have a casing and/or profile elements on its entirety or in part. In particular a rubber casing improves the feel. Such a casing material can also be provided as a buffering material.

The loading lever handle is preferably tensioned in its standby position on the chambering device.

In a technologically or structurally simple design, it is tensioned in place by an elastic element, e.g. a spring element.

During the chambering process of the automatic firearm, preferably only one bearing surface of the chambering device and/or one end surface of the loading lever housing is releasably connected to the breechblock.

The breechblock can be moved backward toward the stock during the chambering via the bearing surface or end surface of the loading lever housing. Advantageously, this is only a form-fitting connection, and supplementary coupling elements needed with the prior art can be eliminated. It is also ensured that the breechblock and the loading lever retainer or loading lever housing, and thus the entire chambering device, are only releasably connected during the chambering process, and not while firing.

It is therefore preferred that while firing the automatic firearm, the chambering device is entirely separated from the breechblock.

Advantageously, the loading lever is thus secured in place while firing. As a result, the safety of the shooter is increased, in particular in stressful situations. At the same time, the shooter is free to assume any shooting position. Such a loading lever is referred to as a non-conjoint movement loading lever. In comparison with a conjoint movement loading lever, e.g. in the known G36 by the same applicant, or the known SA 80, it is possible to avoid injury to the shooter due to the conjoint movement loading lever.

Because the chambering device is entirely separated from the breechblock carrier, it can also be guided separately and locked in place in the receiver.

At least one retaining element is also provided on the loading lever, which latches to or on a counter-retaining element on the receiver, such that the loading lever can be secured to the counter-retaining element.

In a structurally simple design, the retaining element can be, e.g., a retaining lug on the loading lever, in particular the inner surface thereof, facing the receiver.

The retaining element is preferably provided on the loading lever handle, and engages with a complementary counter-retaining element in the receiver, e.g. another retaining lug. Because the loading lever, or its loading lever handle is tensioned in its standby position, it preferably bears on the receiver in this position, wherein its retaining lug engages with the counter-retaining element on the receiver. It can advantageously be ensured in this manner that the chambering device is secured to the receiver during the movement of the breechblock, in particular when firing, thus not moving conjointly. The loading lever bears laterally on the receiver when in the standby position.

The loading lever housing can be solid. Preferably at least one hole passes through it longitudinally, provided in particular for receiving a gas piston rod.

There can also be other holes, in particular for reducing the weight of the loading lever housing. The longitudinal hole for the gas piston rod is basically complementary to the dimensions of the gas piston rod.

The chambering device can preferably be secured in place on the automatic firearm, in particular on the gas piston rod, for manually supported chambering of a round.

After it has been secured to the gas piston rod, the chambering device can be moved forward via the loading lever, toward the chamber, by means of which the breechblock coupled to the gas piston rod is automatically moved forward toward the chamber.

This function serves as an integrated closing aid, in particular for manually supported chambering of a round. Because the chambering device is separated from the breechblock, a connection or coupling is needed for this manual closing function.

The closing aid function eliminates disruptions, e.g. loading disruptions, or for closing the breechblock quietly.

In the actuation position, the loading lever handle can be spring loaded toward the receiver.

The securing of the chambering device on the gas piston rod can take place via appropriate coupling measures.

The chambering device preferably comprises an engagement element that engages in a hole in the gas piston rod, wherein the engagement element can be switched between an engaged position and a released position.

When the loading lever handle is in the actuation position, it can be spring loaded toward the receiver. In a simple design, the engagement element can be a spring loaded locking pin, for example, the outer dimensions of which are basically complementary to the hole in the gas piston rod, such that it passes through the loading lever housing, or the slide, thus securing or retaining the chambering device on the gas piston rod.

The engagement element is preferably tensioned in its released position via an elastic element provided for this.

The elastic element can be an appropriate elastic agent, in particular a spring.

The loading lever is in its outward pivoted position when in the engaged position, thus the actuation position, in which it is folded upward, transverse to the direction of firing. The loading lever can be secured in this position via the engaged position.

If the breechblock is released from its rear position when the loading lever is pivoted outward and secured in place in its engaged position, a front stop on the loading lever housing can strike a fixed stop in the receiver. In this manner, it is ensured that the loading lever is automatically folded down, and again engages with the counter-retaining element on the receiver, after it has been pivoted into its standby position, in which it extends parallel to the receiver.

The loading lever handle can preferably also be slid and/or pivoted into its engaged position only when it is in the actuation position in the loading lever retainer.

In this manner, it is ensured that no unintentional connection to the gas piston rod will take place.

The loading lever handle is preferably hinged at its end facing the chambering device such that it can pivot about a bearing axle in the loading lever retainer between its standby position and its actuation position, and comprises an oblong hole for this, which encompasses the bearing axle, and extends basically transverse to the longitudinal direction of the chambering device when in the actuation position.

In this manner, it is ensured that the bearing axle is guided in the oblong hole.

The oblong hole is basically parallel to the receiver in the standby position, and is at basically 90° to the direction of firing when in its actuation position.

The loading lever handle can preferably pivot about the end of the oblong hole facing the loading lever housing when pivoted between its standby position and its actuation position, and can be displaced in the oblong hole when the loading lever handle is brought into its engaged position such that the bearing axle bears on the end of the oblong hole away from the loading lever housing.

This can be achieved with structurally simple means, and ensures that the overall loading lever handle can be inserted in the defined position, basically over the entire length of the oblong hole in the loading lever retainer, and thus displacing the loading lever handle over a defined distance.

The loading lever handle preferably comprises a locking lug on its end facing the loading lever housing, that engages with the engagement element in the standby position. The locking lug is disengaged from the engagement element when the loading lever handle is pivoted into the actuation position, and pivots and/or slides the engagement element toward the loading lever housing.

The end of the loading lever handle facing the loading lever housing can be rounded, for example, and have a latching recess that engages with the engagement element when in the standby position. For this, the engagement element can be a locking pin or bolt, for example, in a structurally simple design. The latching position prevents unintentional operation when in the standby position.

When in the form of a locking pin or bolt, the undersurface of the pin can have an angled wedge surface, which interacts with the end of the loading lever handle such that when it is pivoted it engages with the wedge surface and pivots or slides the locking pin or bolt toward the gas piston rod. When in the actuation position, which is also combined with the engaged position, the locking pin is then pushed or slid against the gas piston rod such that it engages with the recess provided therein.

The loading lever housing preferably has at least one receiver bearing on each side for receiving and coupling the loading lever retainer.

As a result, a precisely reproducible, defined working position of the loading lever retainer with the loading lever handle coupled to it can be established with structurally simple means. The loading lever retainer can be placed in the receiver bearing from the side. Alternatively, the loading lever retainer can also be inserted into the corresponding guide section in the loading lever housing from the rear or from the front, depending on where the receiver bearing is located on the loading lever housing.

The loading lever retainer can preferably be latched onto the loading lever housing, in particular onto the receiver bearing.

In a structurally simple design, a spring loaded pin or bolt can be provided for this. In this manner, it is possible to securely latch the loading lever retainer in place with structurally simple means.

The loading lever retainer preferably has a spring loaded disassembly element, the actuation of which to a disassembly position disengages the loading lever retainer from the loading lever housing.

By way of example, the disassembly element can be a disassembly slider, the actuation or pulling of which away from the loading lever retainer, preferably counter to the force of a spring, disengages the loading lever retainer from the loading lever housing.

The loading lever housing preferably comprises at least one guide section on each side that engages with and is guided in complementary guide rails in the receiver.

Particularly preferably there are at least two guide sections on each side, which enable a two-point guidance of the loading lever housing. By way of example, the guide sections can be grooves formed in the loading lever housing, and exhibit inner dimensions that are basically complementary to the guide rails.

There is preferably a stop element with a buffer element on the loading lever housing, which strikes a fixed stop in the receiver. When the breechblock moves forward, the loading lever housing strikes the fixed stop in the receiver.

The buffer element reduces the impact forces and can be made of a suitable buffering material.

Preferably, guide rails extend in the interior of the receiver on both sides, in the longitudinal direction of the receiver, for guiding the breechblock carrier via at least two guide sections provided on both sides of the breechblock carrier, and for guiding the loading lever housing via the at least one guide section formed on each side.

The guide rails can be formed as an integral part of the receiver in the production thereof, e.g. through aluminum extrusion. They can also be subsequently placed in the receiver.

There is preferably a hole on at least one side of the receiver, through which the loading lever retainer coupled to the loading lever handle can be placed in or removed from the loading lever housing for assembly or disassembly, respectively, and is guided therein while chambering rounds.

Recesses forming guide slots are particularly preferably provided on both sides in the receiver. These can be formed with structurally simple means, and also serve to receive the loading lever retainer and the loading lever handle. They can also be used for guiding the loading lever handle inside the receiver with a complementary formation of guide sections on the loading lever retainer. The mounting of the loading lever takes place, e.g. through a window in the receiver, or through the receiving thereof in a T-groove in the loading lever housing, for example. There is preferably at least one counter-retaining element on the receiver, to which the loading lever can be secured during the breechblock movement.

In another design, the counter-retaining element can be formed by retaining lugs on the receiver, which are complementary to the retaining elements on the loading lever handle.

DESCRIPTION OF THE FIGURES

Exemplary embodiments of the invention are explained in greater detail below with reference to the attached schematic drawings.

Therein:

FIG. 2*a* shows a perspective view of a first embodiment of the chambering device according to the invention, in a diagonal view from behind and above;

FIG. 3*a* shows a perspective side view of a first embodiment of a slide or loading lever housing according to the invention, in a side view from the left;

FIG. 3*b* shows a perspective side view of a second embodiment of the slide or loading lever housing according to the invention in a side view from the left and above;

FIG. 8 shows a longitudinal sectional view through the loading lever, which shows the loading lever housing or slide in FIG. 7, showing the loading lever locked to the gas piston rod in greater detail;

FIG. 13 shows a perspective view of the slide or loading lever housing in FIG. 11, with the loading lever placed therein, and not locked in place;

FIG. 16*a* shows an overall view of the loading lever housing according to the second embodiment in a side view from the left, in which the loading lever and the breechblock are in their foremost position (standby position);

FIG. 16*b* shows a view from above of the illustration in FIG. 16*a;*

FIG. 20*a* shows a perspective illustration of the slide or loading lever housing of the first embodiment and the corresponding loading lever, shortly before they are coupled;

FIG. 20*b* shows the slide in FIG. 20*a* with the loading lever placed therein, which is not yet latched in place;

FIG. 20*c* shows the slide in FIGS. 20*a* and *b* with the loading lever placed and locked therein;

Figure 1A:
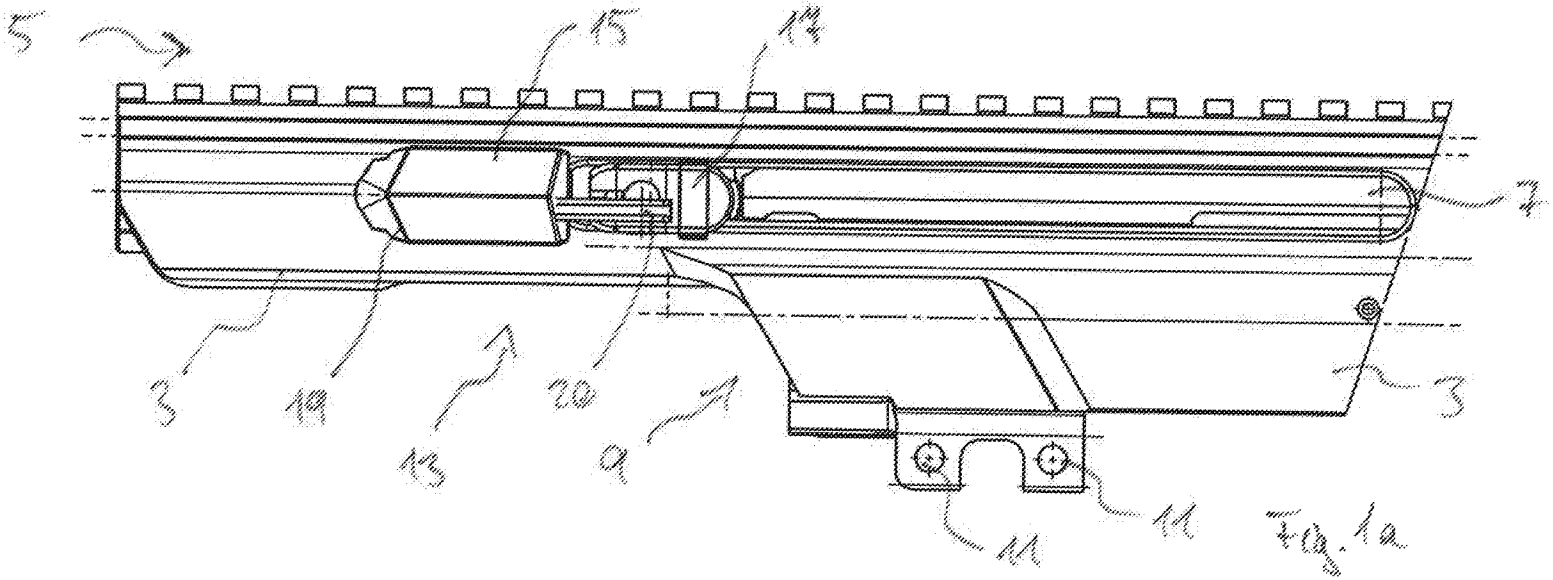
FIG. 1*a* shows a side view of a section of a receiver with a chambering device placed therein in the standby position.

The construction and the functioning of the chambering device according to the invention shall be explained below with reference to the figures.

The reference symbols are not all included in all of the figures, for purposes of clarity. The same reference symbols, however, apply to all of the figures.

The chambering device 1 according to the invention substantially comprises the following components: a loading lever 13, 13', composed of a loading lever handle 15 and a loading lever retainer 17, and which can be coupled to a slide or a loading lever housing 59, 59', which is inserted into the receiver 3.

FIGS. 16*a* to 19*b* show, among other things, the elements of an automatic firearm necessary for the functioning of the chambering device 1, which, in the present case, is an assault rifle, specifically the HK433 by the applicant.

The HK433 is a so-called indirect gas operated loader with a short stroke gas piston system and a rotating lugged loading lever. The short stroke gas piston transfers an impulse to the breechblock carrier via a piston rod after a round has been fired. A short stroke gas piston is distinguished by a short movement path, which is sufficient for transferring a corresponding drive impulse to the piston rod, or the breechblock assembly. The short stroke gas piston is not permanently connected to a piston rod of the breechblock assembly. The breechblock comprises a breechblock carrier 119 and a breechblock head 172. The breechblock carrier 119 can move longitudinally in the known manner in the receiver 3 or the upper part thereof.

Figures 17A, 17B:
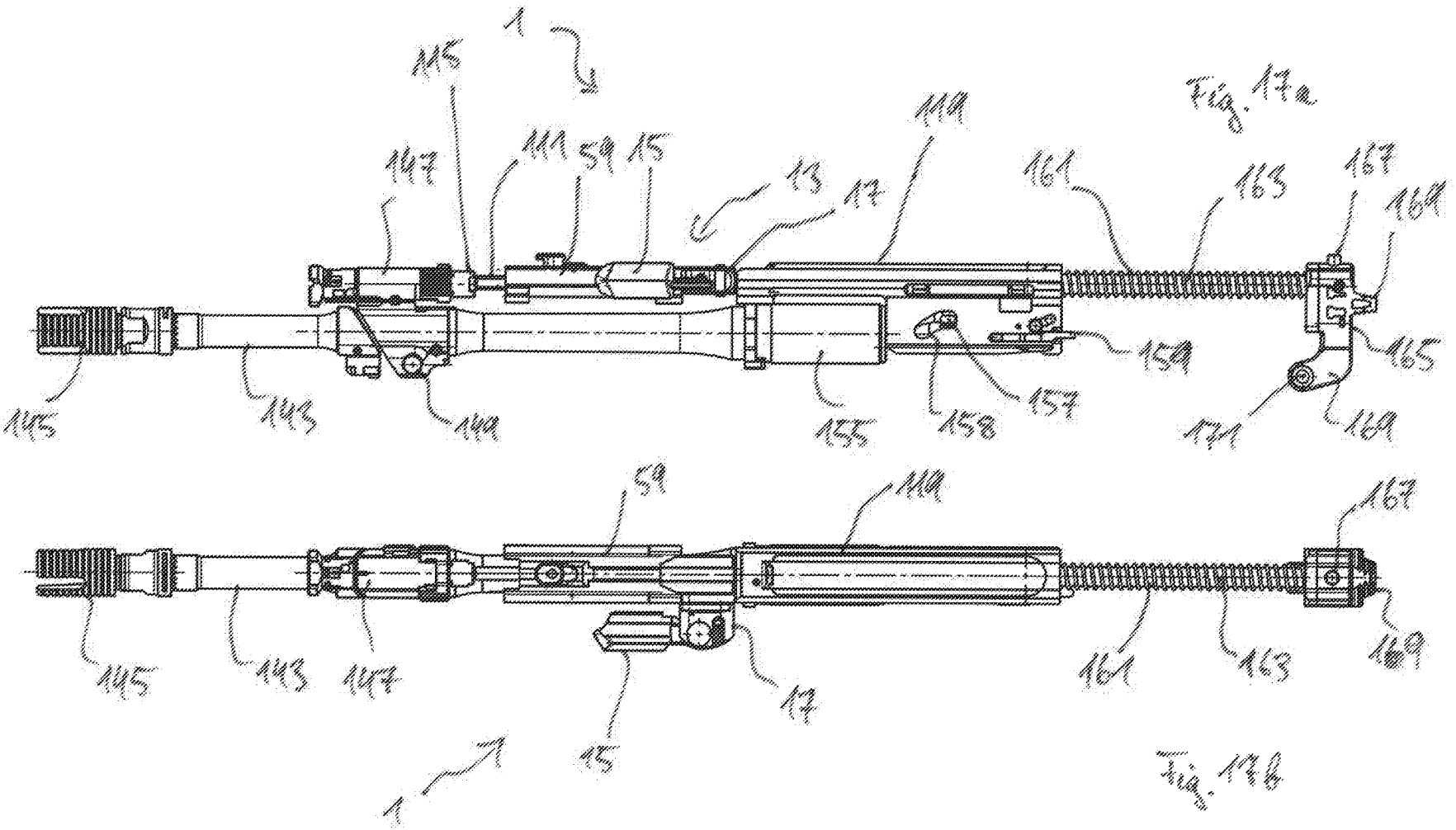
FIG. 17*a* shows an overall view of the chambering device in FIG. 16*a*, without the receiver.
FIG. 17*b* shows a view from above of the illustration in FIG. 17*a;*
Figures 18A, 18B:
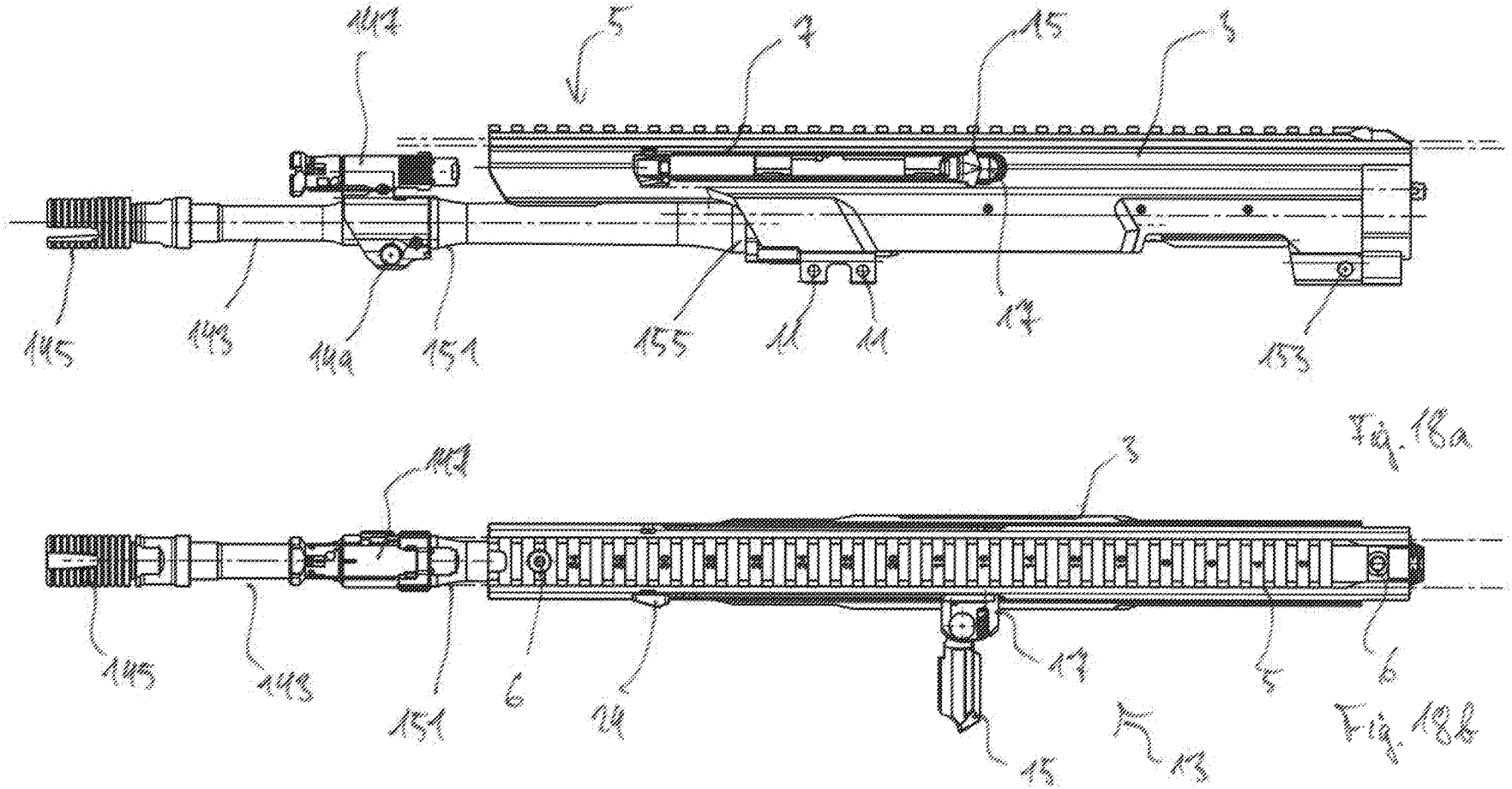
FIG. 18*a* shows an overall view of the chambering device in FIGS. 16*a* to 17*a*, in which the loading lever and the breechblock are in their rearmost position (chambering position)
FIG. 18*b* shows a view from above of the illustration in FIG. 18*a;*

FIGS. 16*a* to 17*b* show the chambering device 1 in the standby position, in which the loading lever housing or slide 59, 59' bears with its rear end (bearing surface 121 of the loading lever retainer 17) on the front end of the breechblock carrier 119 (cf. FIGS. 17*a* and 17*b*). The loading lever handle 15 is close to the front end of the guide slots 7 in the receiver 3, and is latched in place there via a retaining lug 23 on its inner surface 22, with a complementary counter-retaining element 24 on the receiver 3. The breechblock carrier 119 is in its foremost position, in which the breechblock head 172 is locked in place in the chamber 155 (cf. FIG. 17*a*).

When in this position, a magazine (not shown) can be inserted into the automatic firearm from below in the known manner.

The chambering device 1 can be operated to then insert a cartridge (not shown) into the chamber 155, thus to ready the automatic firearm for firing. For this, a shooter grips the loading lever handle 15 of the loading lever and folds it back and away from the automatic firearm, such that it projects laterally away from the upper part of the receiver 3 at basically a 90° angle in its actuation position (cf. FIGS. 18*b* and 19*b*).

The chambering device 1 can then be moved backward toward the stock (not shown) via the loading lever handle 15, wherein the loading lever handle 15 pushes against the slide or loading lever housing 59, 59' bearing on the front surface of the breechblock carrier 119, and thus guides the slide or loading lever housing 59, 59' and thus the breechblock carrier 119 counter the pressure of the closing spring 161 (cf. FIGS. 17*a* and 17*b*). The loading lever housing or slide 59, 59' is pushed into the receiver 3 thereby.

The breechblock carrier 119 and the chambering device 1 guiding it are in their rearmost position in FIGS. 18*a* to 19*b*. When the breechblock carrier 119 is brought into this position, the breechblock head 172 slides over the magazine, as described above. In the subsequent forward movement, it can grip a cartridge (not shown), remove it from the magazine, and insert it into the chamber 155. When the chambering device 1 moves forward, and the breechblock carrier 119 folds the loading lever handle 15 of the loading lever 13, 13' back toward the receiver 3, and ends up back in its starting position, or standby position (cf. FIGS. 16*a* and 16*b*) in which the breechblock head 172 is locked in the chamber 155 in the known manner. The weapon is now ready to fire.

If there is a loading obstruction, or an automatic closing of the breechblock system or breechblock carrier 119 is not possible, a shooter can also secure the loading lever handle 15 inside the loading lever retainer 17 and in the gas piston rod 111 via a closing aid pin 125 (cr. FIGS. 6*c* and 8), in a recess 127 provided on both sides of the gas piston rod 111, such that the loading lever handle 15 does not automatically pivot into its standby position, but instead is secured at basically a right angle thereto. A shooter can then loading lever housing the chambering device 1 forward via the loading lever handle 15. The loading lever handle 15 then first pivots back to its standby position when it is removed from its latched position, or strikes a fixed stop 109, secured to the receiver 3 via a fastener screw 6, when the loading lever moves forward (cf. FIGS. 4*a* to 6*a* and 9).

The chambering described above shall now be described in detail with reference to all of the figures.

FIG. 1*a* shows an enlarged detail illustration of the receiver 3. The upper part of the receiver 3 is made of solid aluminum monolithically, and has an integrated Picatinny rail 5 on its upper surface, e.g. in accordance with the NATO standardization agreement. Sights and/or night vision devices can be mounted on the Picatinny rail 5. The breechblock carrier 119 is inserted into the receiver 3 in the known manner, as with G36 by the applicant, such that a functional safety and reliability of the automatic firearm is ensured.

There are receivers 11 on the undersurface 9 of the upper part of the receiver 3, for attaching the stock and hand guard in the known manner. Longitudinal guide slots 7 are provided on both sides of the upper part of the receiver 3, in which the chambering device 1 or its loading lever 13, 13' can be moved. The loading lever 13, 13' comprises the loading lever handle 15 and the loading lever retainer 17, the details of which are enlarged in FIGS. 2*a* and 2*b*. The loading lever retainer 17 can be mounted on removed from the automatic firearm on the left side and/or the right side without tools. It is placed in the slide or loading lever housing 59,59' thereby (cf. enlarged illustration of the embodiment in FIGS. 3*a* and 3*b*).

Figure 1B:
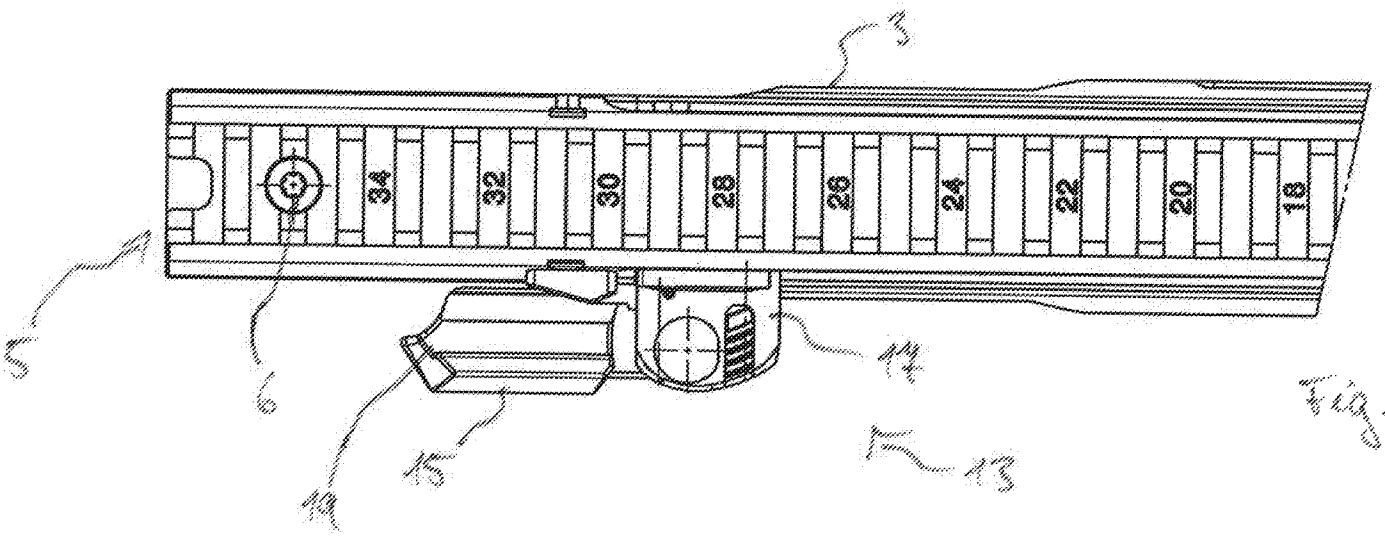
FIG. 1*b* shows a view of the illustration in FIG. 1*a* from above.
Figure 7A:
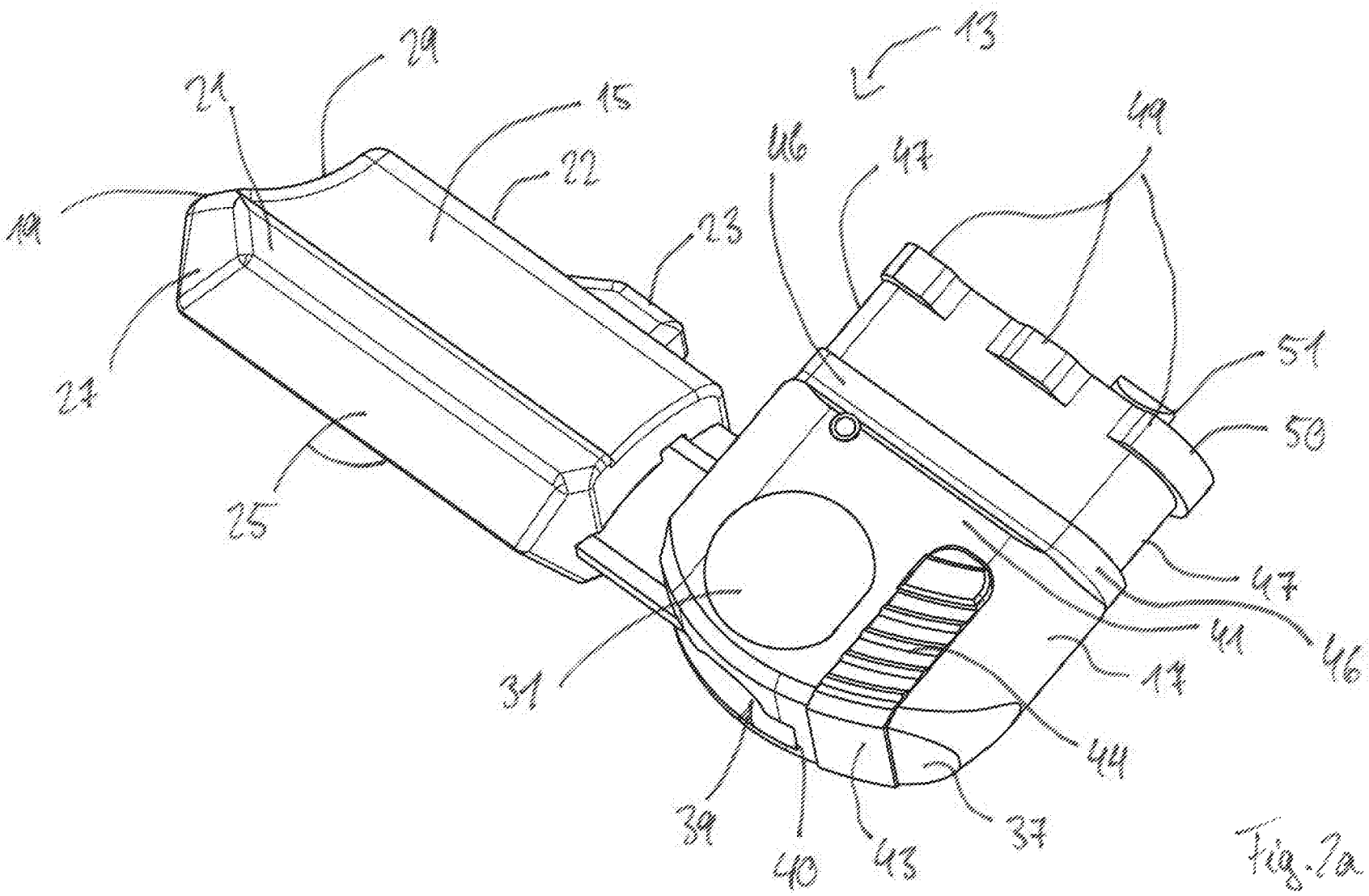
FIG. 7 shows a sectional view of the slide or loading lever housing in FIGS. 4*a* to 6*c* with the loading lever retainer bearing on the breechblock carrier in a view from above.

The loading lever 13 is in its standby position in FIGS. 1*a* and 1*b*, in which it is latched in place via a retaining lug 23 on its inner surface 22 extending toward the receiver with a complementary counter-retaining element 24 on the upper part of the receiver 3. Because of this latching, the loading lever 13 (13') is secured to the upper part of the receiver 3, such that it does not follow the movement of the breechblock, and instead, the breechblock carrier 119 can move freely and independently.

The inner end 20 of the loading lever handle 15 is pivotably supported in the loading lever retainer (cf. FIGS. 2*a* and 2*b* and 4*a* to 6*c*, 10, and 11).

Because the loading lever 13 (13') bears laterally flush against the receiver 3 when it is in its standby position, and is latched in place there, it is also referred to as a non-conjoint movement loading lever 13 (13'). Because it does not move with the breechblock, the loading lever 13 (13') remains in its latched standby position while firing the firearm (cf. FIGS. 1*a* and 1*b*). The stationary loading lever 13 (13') increases the safety of a shooter and prevents any injury thereto. The shooter is also not limited to any particular posture or shooting position for firing the automatic firearm. The loading lever 13 (13') can be moved from the left side to the right side of the weapon, and is therefore ambidextrous. The loading lever 13 (13') also has a closing aid function, for a quiet chambering of rounds in the chamber 155 (cf. FIGS. 6*c* and 8, etc.).

Figure 2B:
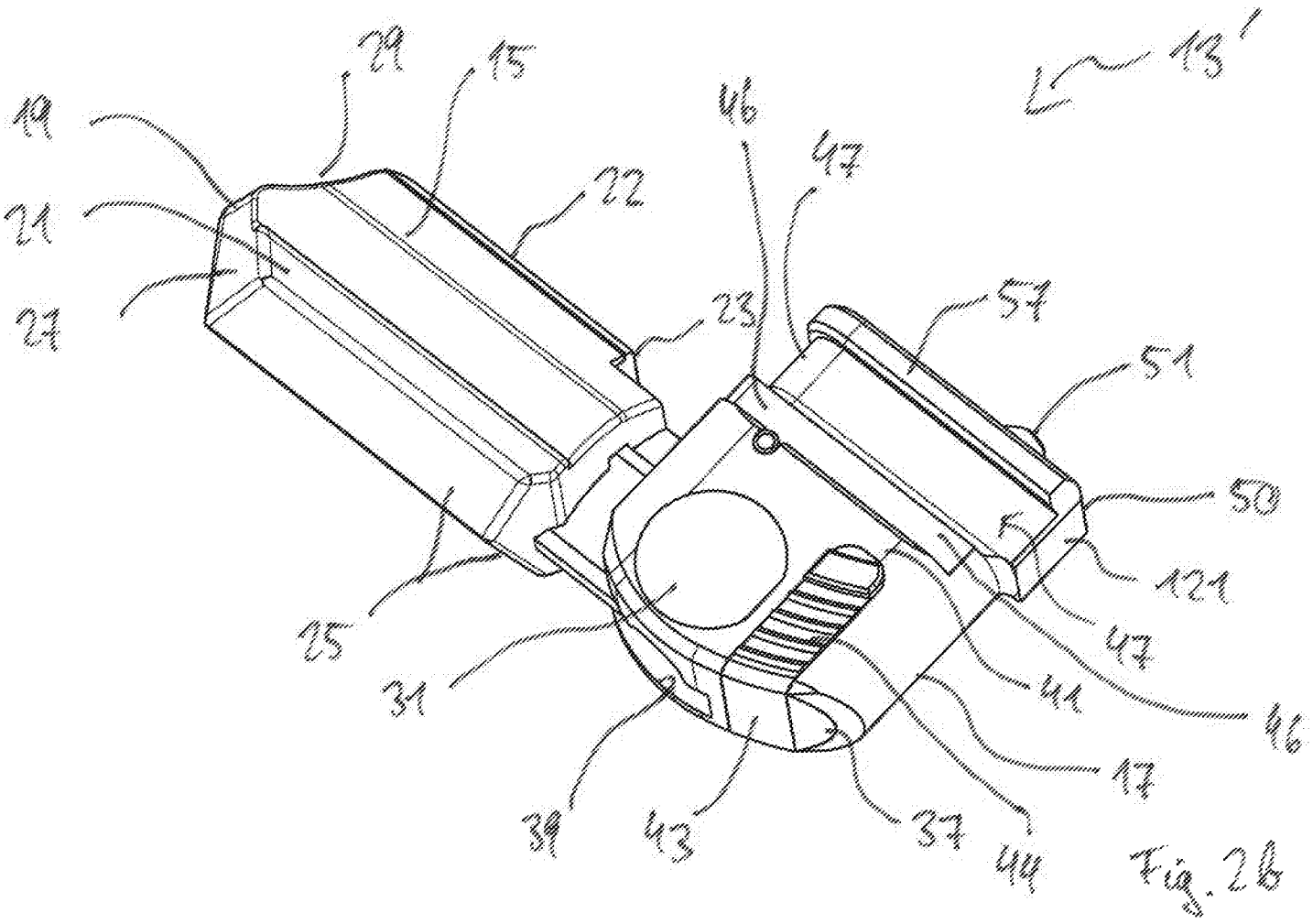
FIG. 2*b* shows a perspective view of a second embodiment of the chambering device according to the invention, in a diagonal view from behind and above.

FIG. 2*a* shows a first embodiment of a loading lever 13 according to the invention, and FIG. 2*b* shows a second embodiment 13'. The loading lever 13, 13' is shown in its standby or starting position in each case, and is basically in the form of a horizontal "L." The long leg of the "L" forms the loading lever handle 15, which can have a rubber casing 21 extending entirely or in part over its outer retaining and handle section. The loading lever handle 15 comprises an outer end 19 and an inner end 20. There is a retaining lug 23 the inner surface 22 of the loading lever handle 15, thus the side facing the receiver in the assembled state, for latching the loading lever to the receiver 3, as described in the introduction.

The outer surface facing away from the receiver 3 comprises two slanted surfaces 25 extending longitudinally, basically in the shape of a wedge. These are also beveled via wedge-shaped surfaces 27 toward the outer end 19 of the loading lever handle 15, toward the front and downward. At the front end, the outer end 19 of the loading lever handle 15 transitions to a basically semicircular cross section, via a rounded undersurface 29 at the inside 22.

The inner end 20 of the loading lever handle is located inside a slot 39 in the loading lever retainer 17 such that it can pivot about a loading lever axle 31. For this, an oblong hole 33 (cf. FIGS. 4*c*, 5*c*, 6*c* and 8) passes through an inner end 20 of the loading lever handle 15 in the longitudinal direction. The slot 39 passes horizontally through the loading lever retainer 17 such that the loading lever handle 15 can be pivoted 90 degrees from its starting position or standby position, in which it bears on the receiver 3 and is latched in place there, to an actuation position, in which is protrudes at basically a right angle from the upper part of the receiver. The guide slot 39 is delimited at its outer end via a stop 40, which also delimits the pivotal movement of the loading lever handle 15.

A disassembly slider 43 adjoins the stop inside the outer contour or upper surface 37 of the loading lever retainer 17, which can be slid outward, transverse to the longitudinal direction of the loading lever retainer, thus away from the upper part of the receiver 3. The upper and lower surfaces of the disassembly slider 43 have a profiled structure 44, to improve the grip, in particular if it is dirty or the shooter is wearing gloves.

The disassembly slider 43 can be slid out of the outer surface 37 of the loading lever retainer 17 for disassembling the loading lever 13, 13', counter to the force of a disassembly slider spring 45 (cf. 4*c*, 5*c* and 6*c*, etc.). The disassembly slider 43 is coupled on the inside to a locking pin 51 via a bearing pin 123 (cf. FIG. 8, FIGS. 4*c*, 5*c*, 6*c*, 12*b*, 12*c* and 13). The locking pin 51 can loading lever housing inside a bore hole 53 inside the loading lever retainer 17. The bearing pin 123 passes basically vertically through the locking pin 51. Adjacent to the bearing pin 123, the end of the locking pin 51 is basically pin shaped toward the outer surface of the loading lever retainer 17, and thus forms a bearing 124 for the disassembly slider spring 45. The bore hole 53 is a blind hole, such that the disassembly slider spring 45 is braced at its other end on the base of the blind hole 53, and tensions the locking pin 51 of the disassembly slider 43 inward, toward the upper part of the receiver 3. This takes place such that the locking pin 51, as shown in FIG. 2*a*, protrudes out of the undersurface of the loading lever retainer 17 that faces toward the upper part of the receiver 3.

The functioning of the locking pin 51 and the disassembly slider 43 shall be explained below. There is a circumferential recess 47 in the upper surface 41 of the loading lever retainer 17, running toward the undersurface thereof 50, which enables a latching of the loading lever retainer 17 in the slide 59 (59') (cf. FIGS. 3*a* and 3*b*). The loading lever 13, 13' bears with its guide surfaces 46 in the guide slots 7 of the receiver 3 (see FIGS. 2*a*, 2*b*, 7, 10, 13, 20*a*, 20*b*, and 20*c*). Retaining lugs 49 are provided at the ends 50 on the outer circumferential surface of the loading lever retainer 17. The two outer retaining lugs 49 extend circumferentially about the outer contour of the loading lever retainer 17, and the middle retaining lug 49 is likewise formed on the opposite, or lower surface of the loading lever retainer 17, which is not shown.

The dimensions of the retaining lugs 49 fit to their complementary retaining lugs 85 in the bearing 83 over the loading lever retainer 17 (cf. FIG. 3*a*) such that the loading lever retainer can be placed in the bearing 83 from the outside, on the slide or loading lever housing 59. The retaining lugs 49 of the loading lever retainer 17 loading lever housing over the retaining lugs 85 of the slide or loading lever housing 59, until they strike the bearing 83. In this position, the disassembly slider 43 must also be pulled out, counter to the force of the disassembly slider spring 45, such that the locking pin 51 no longer extends over the end or the undersurface 50 of the loading lever retainer 17, but instead is located entirely inside the loading lever retainer 17. The loading lever can then be slid backward, until its rear retaining lug 49 fully bears in the bearing 83.

In this position, the retaining lugs 49 are offset toward the back of the retaining lugs 85, and are thus behind them. The locking pin 51 is located opposite a bore hole 87 in the slide or loading lever housing 59, 59' (cf. FIGS. 3*a* and 3*b*). In this position, the disassembly slider 43 no longer protrudes out of the outer contour 37 of the loading lever retainer 17 (FIG. 2*a*), and the front end of the locking pin 51 enters the bore hole 87, is latched in place therein, and thus secures the loading lever retainer in this position. The disassembly slider is then back in its starting position, shown in FIG. 2*a*. The disassembly slider spring 45 is no longer tensioned at this point.

FIG. 2*b* shows a second embodiment of the loading lever 13 according to the invention, which likewise comprises a loading lever handle 15 and a loading lever retainer 17. The construction and functioning are substantially identical to the loading lever 13 shown in FIG. 2*a*. The loading lever handle 15 differs from the first embodiment by a slightly modified outer contour, in which the front, beveled, wedge-shaped surfaces 27 are somewhat longer. On the inner surface 22, facing the receiver, the retaining lug 23 differs from that in the first embodiment according to FIG. 2*a*, such that it extends over nearly the entire length of the inner surface.

In contrast to the first embodiment according to FIG. 2*a*, there is a continuous retention ridge 57 on the loading lever retainer here. The retention ridge 57 extends from the rear end of the loading lever retainer 17 in a basically u-shaped path over the outer contour of the end 50 facing the receiver 3. The retention ridge 57 allows the loading lever 13 to be inserted into a slide or loading lever housing 59', shown in FIG. 3*b*.

The loading lever housing 59' comprises a bearing 99 with a rail-like, raised guide slot 103, parallel to the continuous retention ridge 57. The loading lever 13' is thus inserted with its retention ridge 57 into the guide slot 103, and is held in place there. For disassembly, as with the first embodiment, the disassembly slider 43 is pulled out of the loading lever retainer 17, counter to the spring force of the disassembly slider spring 45, and the loading lever retainer 17 with its retention ridge 57 can be removed toward the rear from the bearing 99 for the loading lever retainer 17. For the assembly, it is sufficient to simply insert the loading lever retainer 17 with its retention ridge 57 up to the stop in the bearing 99 for the loading lever retainer 17 and it is latched in place in the guide slot 103. The spring loaded locking pin 51 slides over its bevel 52 into and over the inner contour of the bearing 99 for the loading lever retainer 17, and enters the complementary bore 87. The loading lever retainer 17 is entirely secured and latched in place in this position.

The slide or loading lever housing 59 shown in FIG. 3*a* is attached to or removed from the loading lever 13 in the first embodiment according to FIG. 2*a*, and is in the form of an aluminum extrusion. There is a ridge 63 formed on the upper surface 61 of the loading lever housing 59, located in part above the bearings 83 formed on both sides. There is a buffered stop 67 at its front end, thus facing the muzzle of an automatic firearm. This strikes a fixed stop 109 (cf. FIGS. 4*a*, 5*a*, 6*a* and 9), and limits the movement of the loading lever housing, or slide 59 toward the front, beyond its standby position. There is a basically wave-shaped ridge 69 formed at the rear end of the loading lever housing 59. The region between the two ridges 63 and 69 removed on the upper surface of the loading lever housing 59 via a large hole 71 for weight reduction.

A front loading lever housing guide 73 and a rear loading lever housing guide 75 are provided on each side of the loading lever housing 59. Both loading lever housing guides comprise upper guide sections 77 and lower guide sections 79, which engage with guide rails 175 on the inner surface of the upper part of the receiver (cf. FIGS. 21, 22*a* and *b*).

The front and rear loading lever housing guides 73 and 75 collectively form a type of two-point guide, in order to reduce the overall friction of the loading lever housing 49 with respect to the guide rails 175 in the receiver 3.

The bearings 84 for the loading lever retainer 17 extend along both longitudinal sides of the loading lever housing 59, basically adjoining the front loading lever housing guides 73. In the first exemplary embodiment shown here, there are retaining lugs 85 formed on the upper surface and lower surface of the outer contour of the bearing 83. As explained above, the loading lever retainer 17 is placed from the outside thereon, with its complementary retaining lugs 49 between the retaining lugs 85 in the bearing 83, and inserted therein, and then pushed toward the rear under the retaining lugs 85 in the bearing 83, until the retaining lugs 49 latch behind the retaining lugs 85, and the locking pin 51 is located opposite the locking pin bore hole 87 in the loading lever housing 59, and can enter this hole.

There is another through hole 89, basically in the middle of the bearing 83, in which a closing aid pin 125 can be inserted. This can be seen in particular in FIGS. 4*c*, 5*c*, 6*c* and the enlarged detail illustration in FIG. 8. The functioning thereof shall be explained in greater detail in reference to these figures.

The upper lateral surfaces 91 of the loading lever housing 59 are slightly beveled where they are adjacent to the bearing 83, and the undersurfaces of the loading lever housing 59 are likewise cut out in order to reduce weight. There are further cutouts 93 in the longitudinal direction of the loading lever housing 59 on the interior, for further weight reduction. A receiver 95 for the gas piston rod 111 passes longitudinally through the middle of the entire loading lever housing 59. The undersurface of the loading lever housing 59 is rounded in the front and rear loading lever housing guides 73, 75, as is also the case for the section 98 connecting the two sections 73, 75, which extends longitudinally. This improves the guidance of the loading lever housing 59 and the gas piston rod 111.

FIG. 3*b* shows the second embodiment of the loading lever housing 59' in which the loading lever 13' according to FIG. 2*b* is placed, and removed from. The loading lever housing 59' likewise comprises front and rear loading lever housing guides 73 and 75 on each side, which have upper and lower guide sections 77 and 79. The region 107 between the guide slides 73 and 75 is more or less cut out over its circumference. For this reason, in contrast to the first embodiment, there are no further cutouts extending longitudinally in the interior of the loading lever housing 59'.

There is a buffer bearing 104 on the upper surface of the loading lever housing 59', in the proximity of the front loading lever housing guide 73, which can engage with a rubber buffer 106 (cf. FIGS. 4*a*, 5*a*, 6*a* and 9). The rubber buffer 106 can be secured to the buffer bearing 104 via a transverse pin (not shown), that can be inserted in the transverse pin bearing 105. The buffer 106 strikes the fixed stop 109 on the inner surface of the receiver (cf. FIGS. 4*a*, 5*a*, 6*a*, and 9), and limits the movement of the chambering device 1, as in the first exemplary embodiment, such that it cannot move beyond its standby position.

There are bearings 99 for the loading lever retainer 17 in FIG. 2*b* at the rear end of the loading lever housing 59' on both sides. These comprise a continuous, basically u-shaped, guide slot 103, which engage with the complementary circumferential retention ridge 57. The loading lever 13' can be inserted from the left and/or right sides, thus ambidextrously, wherein it can be inserted entirely, until reaching a stop in the left or right side bearing 99. The two bearings 99 each extend to the rear end 101 of the loading lever housing 59'. There is a basically square receiver 95 for the gas piston rod 111, extending longitudinally in the middle of the loading lever housing 59', which passes through the loading lever housing 59' from its rear end 101 to the front surface. The undersurface of the loading lever housing 59' comprises a rounded contour 97, extending over its entire length, and has a wider cross section in the regions of the front and rear loading lever housing guides 73, 75 for the loading lever housing 59'.

Figure 5A:
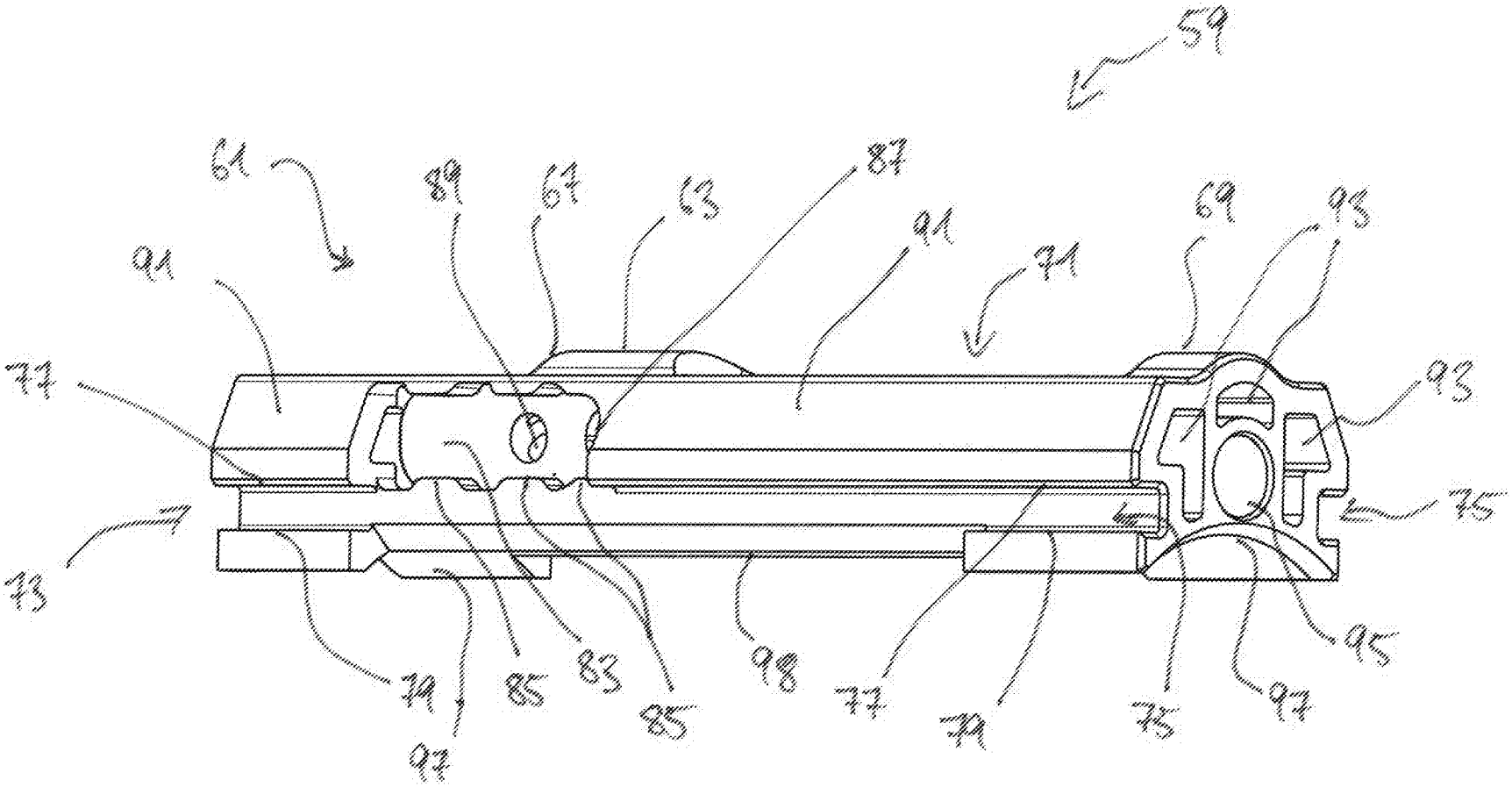
FIG. 5*a* shows a side view of the slide in FIG. 4*a* with the loading lever folded down at the side.
Figure 5B:
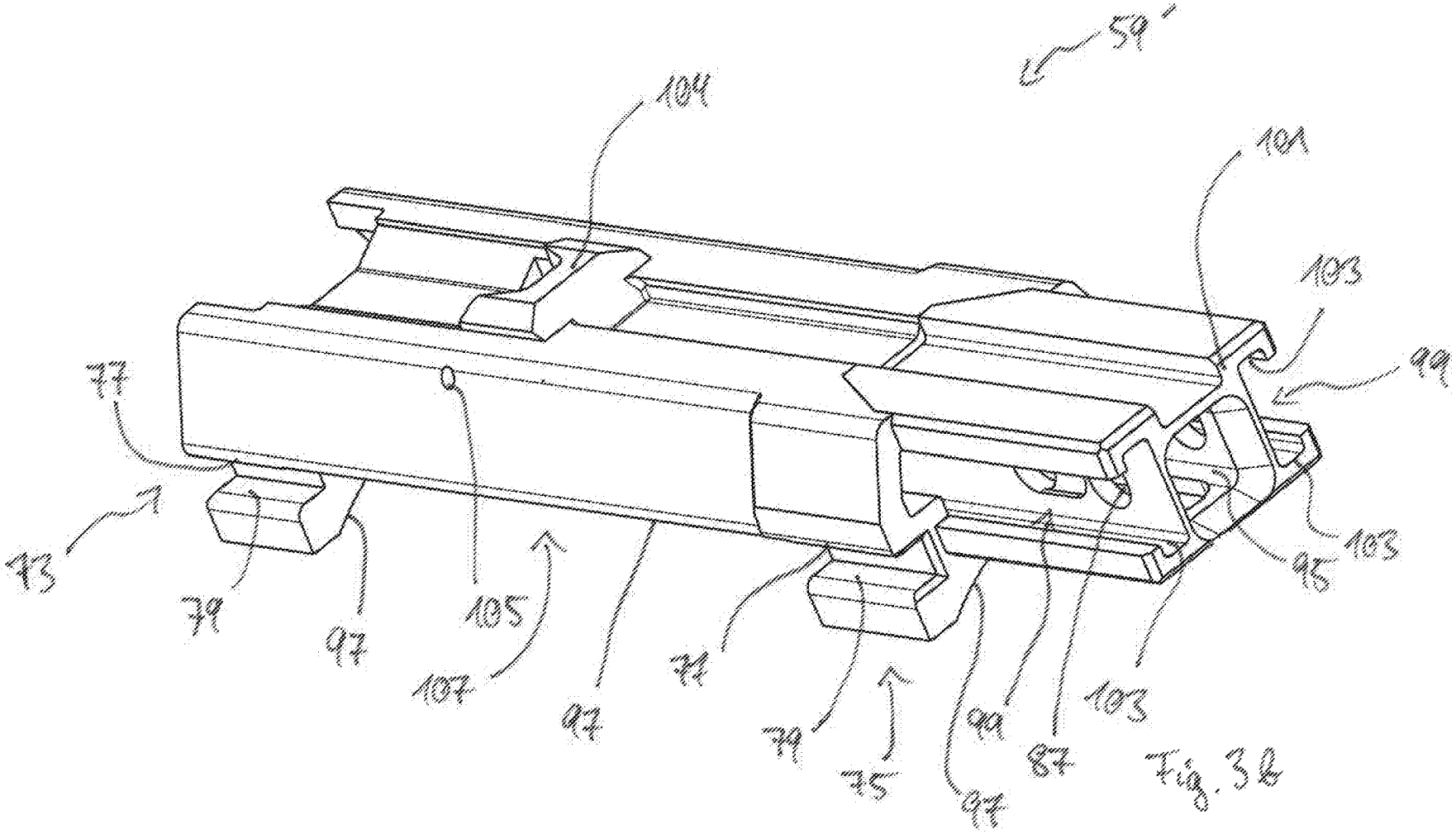
FIG. 5*b* shows a cross section view of the slide in FIG. 5*a* cut along the cutting plane I-I.
Figure 4B:
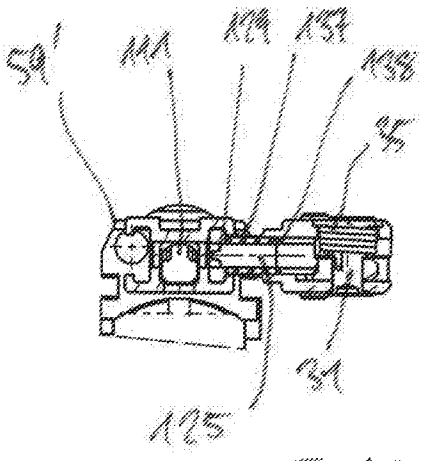
FIG. 4*b* shows a cross section of the slide in FIG. 4*a*, cut along the cutting plane I-I.
Figure 4A:
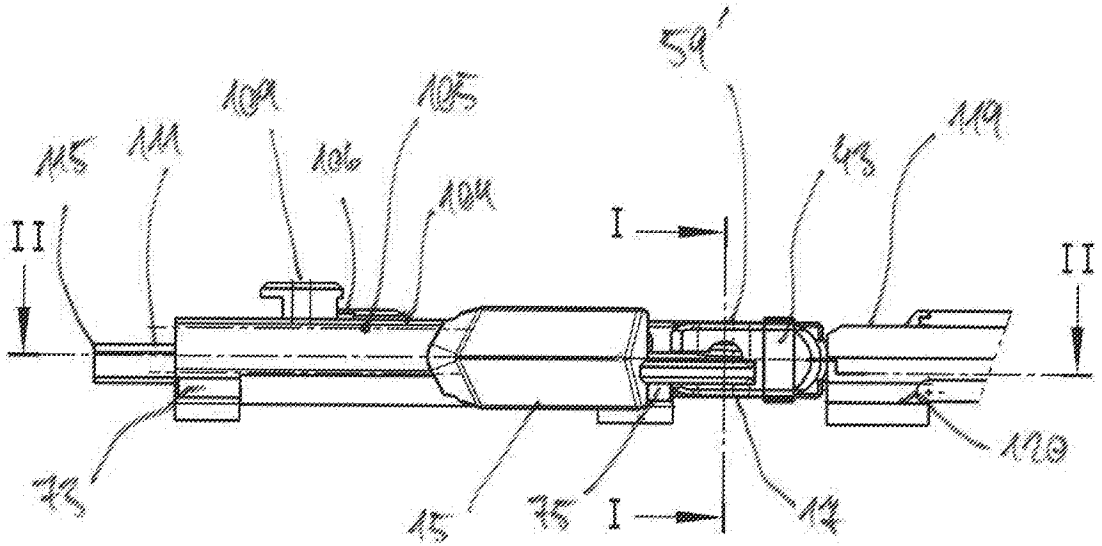
FIG. 4*a* shows a side view of the second embodiment of the slide in FIG. 3*b*, with the loading lever placed thereon in the standby position, in a side view.
Figure 5B:
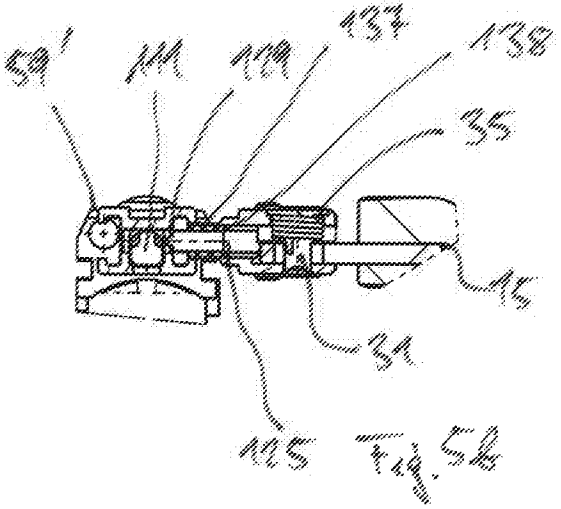
Figure 5A:
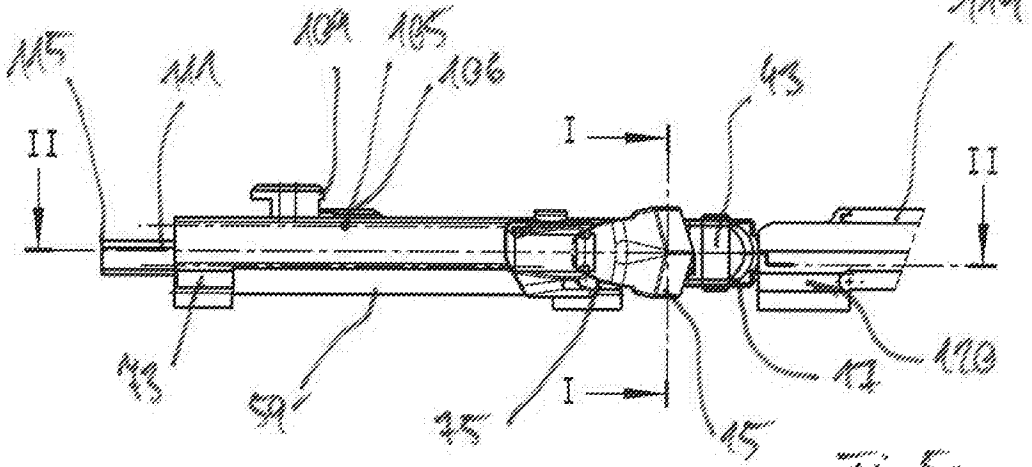
Figure 5C:
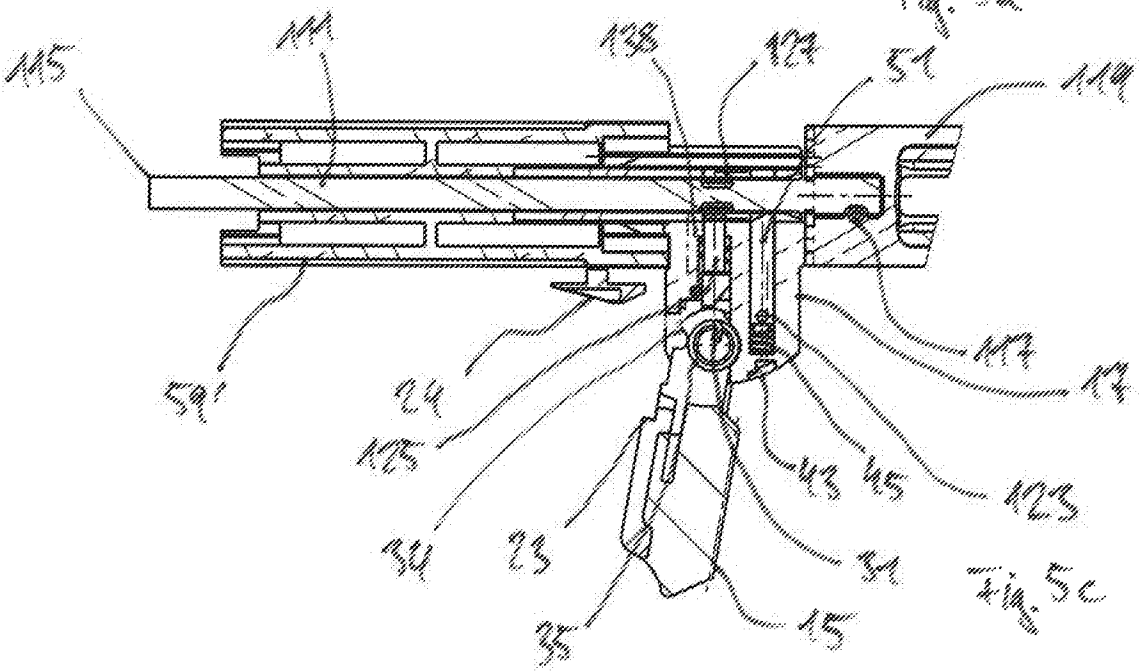
FIG. 5*c* shows a longitudinal sectional view cut through the slide in FIG. 5*a* along the cutting plane II-II, from above.
Figure 6B:
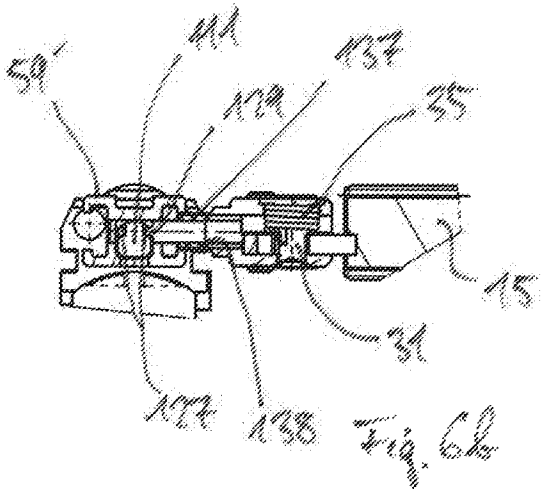
FIG. 6*b* shows a cross section view cut along the cutting plane I-I.
Figure 6A:
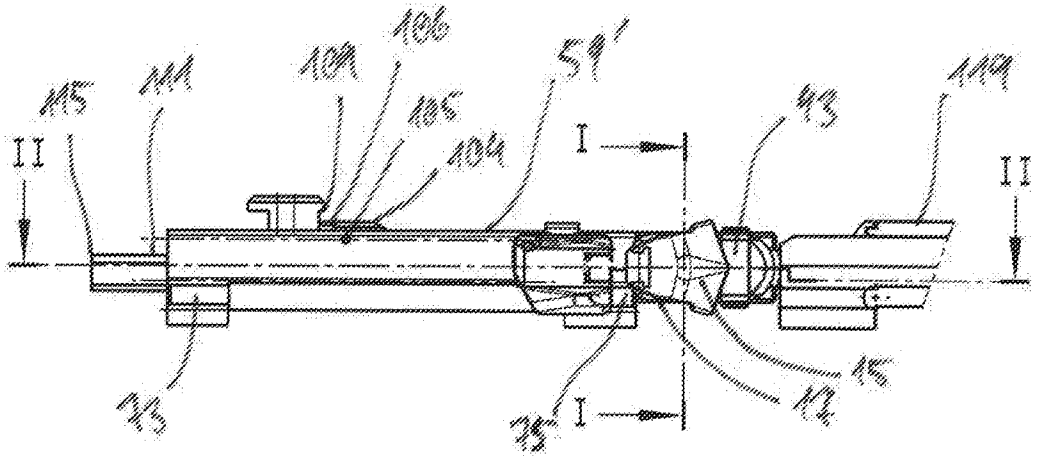
FIG. 6*a* shows a sectional side view of the slide in FIG. 5*a* with the fully folded out loading lever latched to a gas piston rod.
Figure 6C:
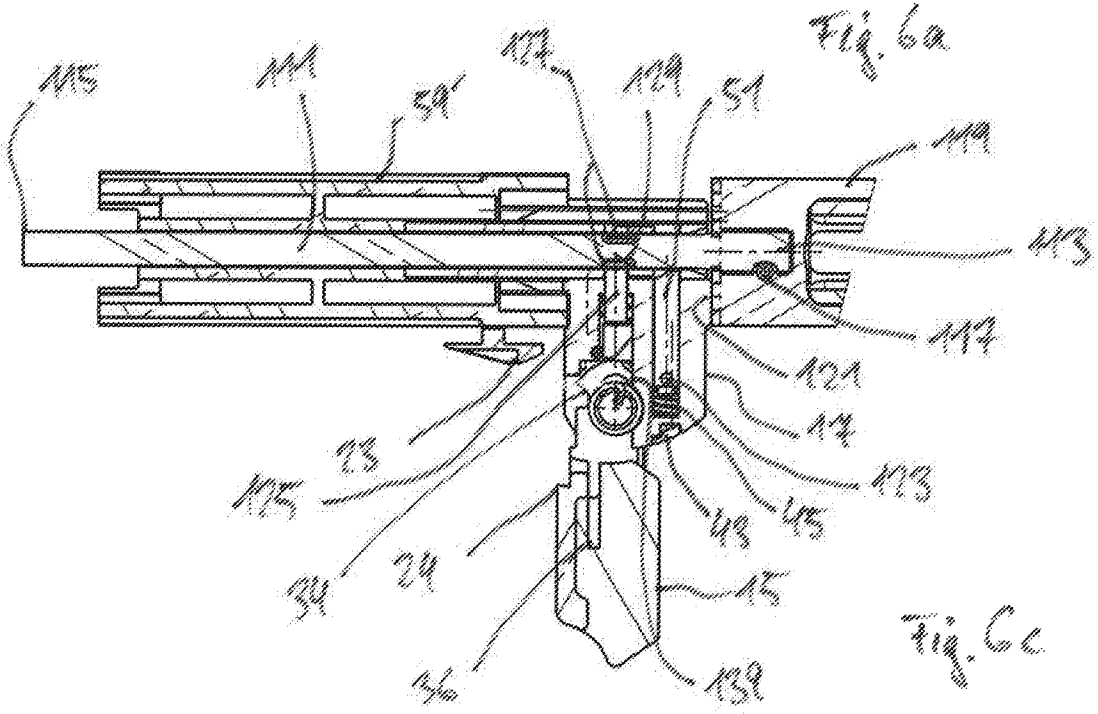
FIG. 6*c* shows a longitudinal sectional view of the slide in FIG. 6*a*, cut along the cutting plane II-II, from above.

FIGS. 4*a*, 5*a* and 6*a* each show a side view of the loading lever housing 59' (second embodiment) in FIG. 3*b*, with the loading lever 13' mounted thereon, and a section of the breechblock carrier (cf. FIGS. 4*a*, 5*a*, and 6*a*). A gas piston rod 111 of the automatic firearm passes through the loading lever housing 59'. FIGS. 4*b*, 5*b*, and 6*b* each show a cross section cut along the cutting plane I-I, and FIGS. 4*c*, 5*c* and 6*c* each show a longitudinal section cut along the cutting plane II-II.

Figure 4C:
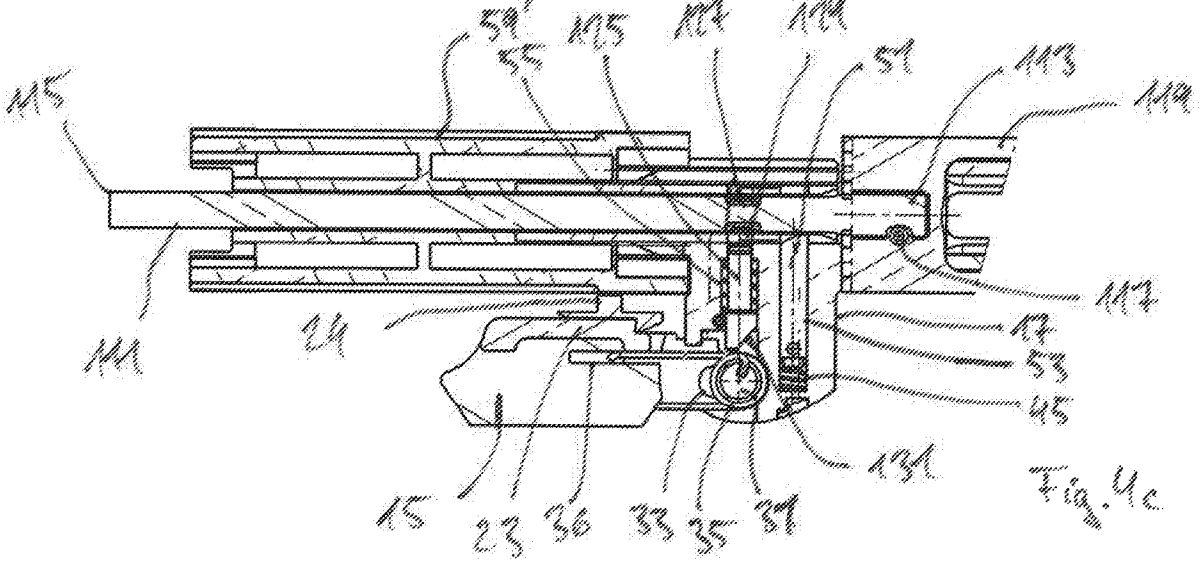
FIG. 4*c* shows a longitudinal sectional illustration cut through the slide in FIG. 4*a* along the cutting plane II-II.

The loading lever 13' is secured in FIGS. 4*a* to 4*c* in the associated bearing 99 of the loading lever housing 59' via the loading lever retainer 17, wherein the locking pin 51 of the disassembly slider 43 is engaged in the associated bore hole 87. The loading lever handle 15 is latched in FIG. 4*a* via its loading lever latch or retaining lugs 23 to the receiver (not shown) at the counter-retaining element 24 provided there, and secured in place. When the breechblock carrier 119 moves, the loading lever 13 thus does not move with it. The rubber buffer 106 is secured on the upper surface of the loading lever housing 59' via a transverse pin (not shown) in the transverse pin bearing 105 on the buffer bearing 104. The rubber buffer 106 bears on the fixed stop 109 of the receiver (not shown herein), and limits a forward movement of the chambering device 1. There is a breechblock carrier guide 120 on the front end of the breechblock carrier 119 for guidance thereof on a guide rail 175 (cf. FIGS. 21, 22*a, b*) on the inner surface of the receiver 3. The breechblock guide 120 is likewise formed on both sides of the breechblock 119.

The loading lever housing 59' is slid onto the gas piston rod 111 over the front end 115 thereof, and it passes through the loading lever housing 59', such that it can move longitudinally therein. The rear end 113 of the gas piston rod 111 (cf. FIG. 8 and FIGS. 4*c*, 5*c* and 6*c*) is placed in the middle of a complementary cut out 117 in the front end of the breechblock carrier 119, secured in the known manner via a threading (not shown), and secured by a transverse pin 117. The loading lever retainer 17 bears at its rear bearing surface 121 on the front end of the breechblock carrier 119.

The loading lever handle 15 is folded away from the loading lever housing 59', toward the back, into its actuation position, in FIGS. 5*a*, 5*b* and 5*c*. The loading lever handle 15 can be pivoted about the loading lever axle 31, counter to the force of the spring 35, and is guided thereby into the rear end of the oblong hole 33. The locking pin 51 of the disassembly slider 43 engages in the associated hole 87 in the loading lever housing 59'.

The closing aid pin 125 is also shown in FIGS. 4*b* and 4*c*, as well as the parallel FIGS. 5*b*, 5*c* and 6*b*, 6*c*, which can move inside a bore hole 55 inside the loading lever retainer 17, transverse to the longitudinal direction of the automatic firearm, and parallel to the locking pin. The closing aid pin 125 comprises an inner end 129, facing the gas piston rod 111, and which can engage in a recess 127 in the gas piston rod 111. The closing aid pin 125 is encompassed by a spring 137, which is braced at one end on a projection on the closing aid pin 125 and braced at its end facing the loading lever housing 59' on a closing aid spring bearing 138, which tensions the closing aid pin 125 toward the loading lever axle 31.

In the standby position of the loading lever 13 shown in FIGS. 4*a* to 4*c*, a wedge shaped end section 131 of the closing aid pin 125 engages with a locking latch 34 on the inner end 20 of the loading lever handle 15 above the oblong hole 33, basically having the shape of a rounded trapezoid. This locking latch 34 provides a supplementary retention of the loading lever handle 15 in its locked standby position.

When the loading lever handle 15 is pivoted out of its standby position shown in FIGS. 5*a* to 5*c*, the loading lever latch 23 is disengaged from the counter-retaining element 24 on the receiver 3, and the loading lever handle 15 is folded down, about 80 to 85 degrees to the gas piston rod 111. As shown in FIGS. 4*b*, 5*b*, and 6*c*, the bearing axle 31 is encompassed by a spring 35, which also tensions the loading lever handle 15 in its standby position. The transition to the actuation position (cf. FIGS. 5*a* to 5*c*) thus takes place counter to the spring force of the spring 35.

When the loading lever handle 15 is pivoted, the inner end 20 of the loading lever handle 15 rotates about the bearing axle 31. In doing so, the wedge shaped end 131 of the closing aid pin 125 moves in relation to the locking latch 34, such that when the rounded inner end 20 of the loading lever handle 15 strikes the wedge surface 131, the closing aid pin 125 is slid in the loading lever retainer 17 toward the gas piston rod 111. As can be seen in FIGS. 5*b* and 5*c*, the closing aid pin 125 protrudes from its bore hole 55 in the loading lever retainer 17 toward the gas piston rod 111, but is not yet engaged in one of the recesses 127 formed in both sides of the gas piston rod 111.

The loading lever handle 15 is in its closing aid position in FIGS. 6*a* o 6*c*. In this position, the loading lever handle 15 is pivoted approximately 90 degrees toward the rear, and is also slid manually into the loading lever retainer 17. The closing aid pin 125 is inserted therein from the inner end 20 of the loading lever handle 15, counter to the force of the closing aid pin spring 137, such that the closing aid pin 125 engages with its end facing the gas piston rod 111 in one of the two recesses 127 in the gas piston rod 111.

In this secured closing aid position, the loading lever handle 15 and thus the chambering device 1 can be moved toward the muzzle of the firearm, wherein, because the closing aid pin 125 is secured in the recess 127, the entire loading lever 13 is secured to the gas piston rod 111. Because the gas piston rod 111 is engaged with the breechblock carrier 119, as described above, the gas piston rod 111, the loading lever 13, and the breechblock carrier 119 can be moved forward, in order to bring the breechblock carrier 119 forward, from a not fully closed position to its closed position (cf. FIGS. 16*a* to 17*b*), for example, wherein the breechblock head 172 guides a cartridge fully into the chamber 155, and locks it in place there. In the closing aid position, a cartridge, for example, can thus be guided into position manually, and thus quietly. The latched loading lever 13 can also be used as a closing aid for this.

FIG. 6*a* shows the position in which the breechblock head 172 is locked in the chamber 155. The rubber buffer 106 bears here on the fixed stop 109 in the receiver 3, and the loading lever retainer 17 bears with a stop surface 121 on the front surface of the breechblock carrier 119.

While chambering rounds, the loading lever 13/13' can be moved back to its actuation position as well as its closing aid position. In practice, the closing aid pin 125 is not locked in place for chambering rounds. When it is locked in place, however, the loading lever handle 15 of the loading lever 13/13' is automatically pivoted to its starting position when the breechblock carrier and the loading lever housing 59' such that a part of the firearm does not protrude or extend outward unintentionally, possibly injuring the shooter while firing the firearm.

The loading lever handle 15 and the closing aid pin 125 are automatically disengaged from the closing aid position when the loading lever handle 15 is released from its rearmost position (cf. FIGS. 18 and 18*a* to 19*b*), and the closing spring 161 of the breechblock carrier 119 and thus the loading lever housing 59' and the loading lever 13 are driven forward, and strike the chambering device on the receiver. The actuation position is also referred to as the chambering position.

Figure 7:
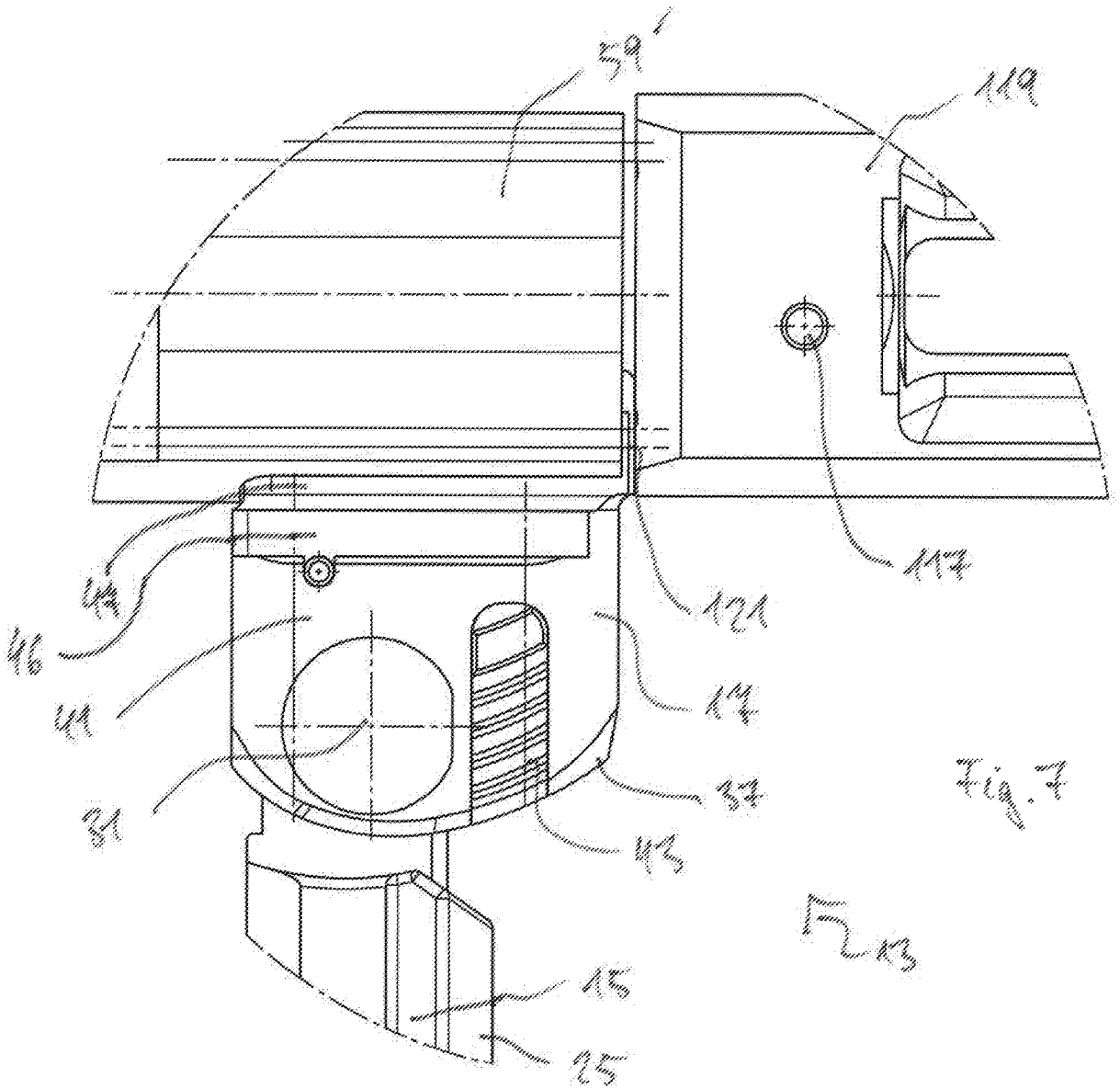
Figure 6:
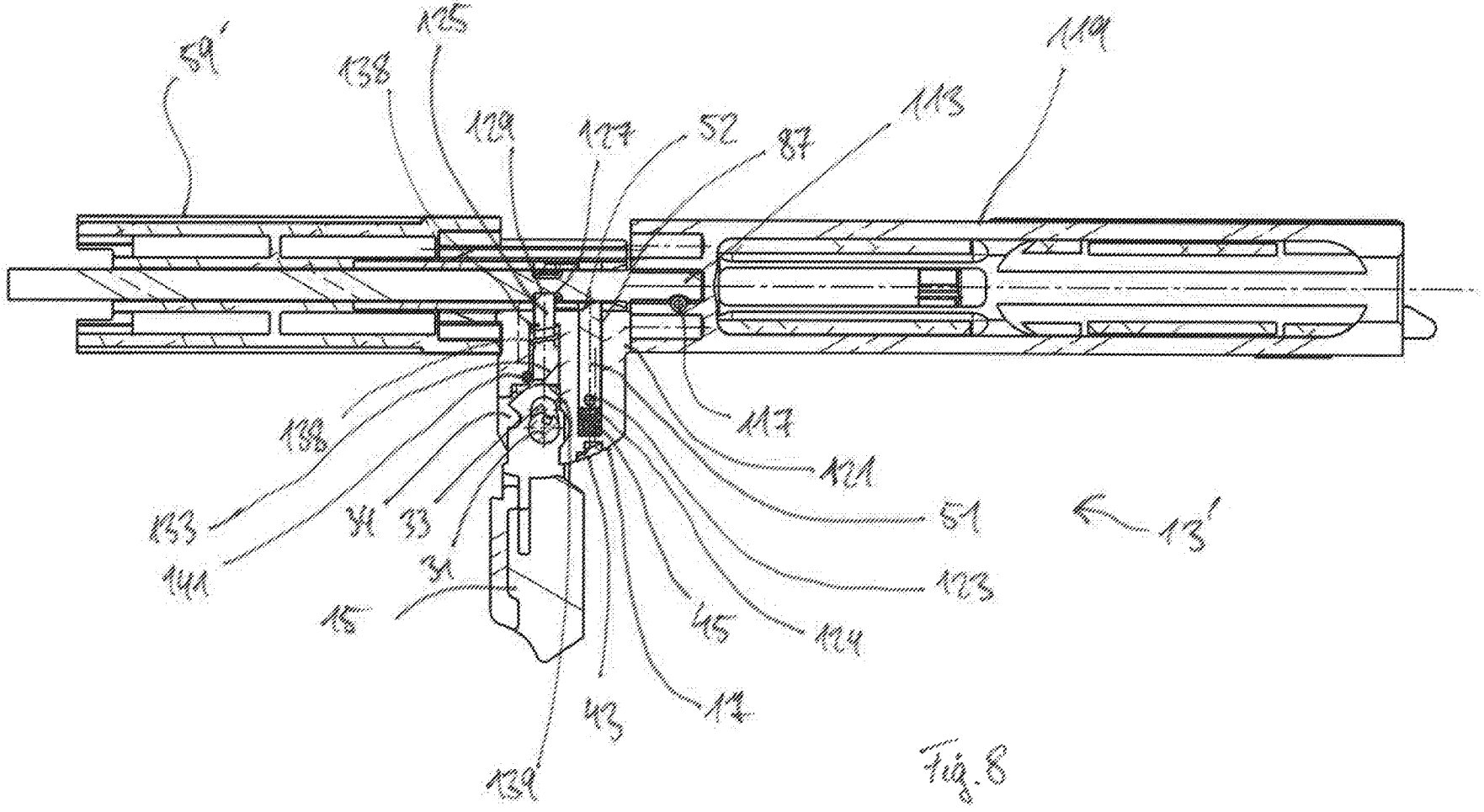

FIG. 7 shows an enlarged detail illustration of the loading lever handle 15 and the loading lever retainer 17, as well as the loading lever 13' in the closing aid position. The disassembly slider 43 is slid entirely into the loading lever retainer 17, thus securing the locking pin 51. When the loading lever handle is slid in, the closing aid pin 125 is pushed the length of the oblong hole 33, until striking the loading lever axle 31 at the second end of the oblong hole 33.

FIG. 8 shows a longitudinal section cut through the view shown in FIG. 7. The loading lever 13' is in its closing aid position, in which the closing aid pin 125 engages at its end 129 with the recess 127 in the gas piston rod 111. At this point, the oblong hole 33 bears on the loading lever axle 31 at its end toward the loading lever handle 15. The wedge surface 133 on the opposite end of the closing aid pin 125 is disengaged from the latching recess 34 on the inner end 20 of the loading lever handle 15. In addition, a blocking and locking pin 141 is shown, which limits the movement of the closing aid pin 125 inside the loading lever retainer 17, and prevents a skewing of the closing aid pin 125. The inner end 20 of the loading lever handle 15 comprises a locking surface 139, via which the inner end 20 of the loading lever handle 15 is braced against the inner housing of the loading lever 13/13' when the loading lever handle 15 is in the closing aid position. The locking surface is large enough to counteract any wear caused by the movement of the loading lever. The locking surface 139 prevents a folding down of the loading lever handle 15 toward the front.

Figure 9:
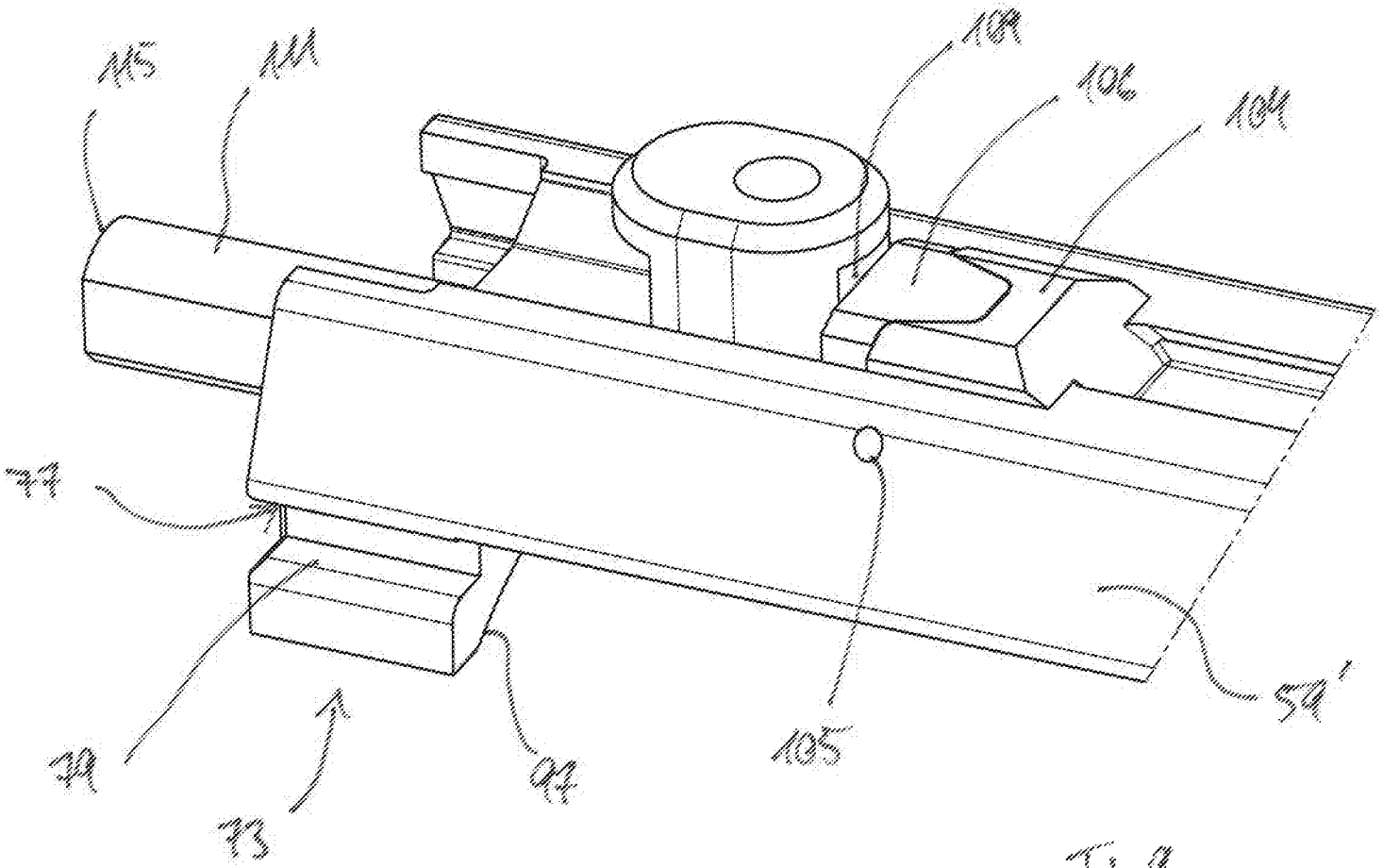
FIG. 9 shows a perspective detail view of the slide or loading lever housing in accordance with the second embodiment, in a view from the left and above.

FIG. 9 shows an enlarged detail illustration of the front surface of the loading lever housing 59' shown in FIGS. 4*a* to 6*c*, with its front loading lever housing guide 73. The rubber buffer 106 is supported in the buffer bearing 104 via the cross pin (not shown) that can be inserted in the cross pin bearing 105. The buffer 106 bears on the fixed stop 109 when the chambering device is in the standby position inside the receiver 3. The fixed stop 109 limits the forward movement of the loading lever housing 59' toward the muzzle, beyond the standby position.

Figure 10:
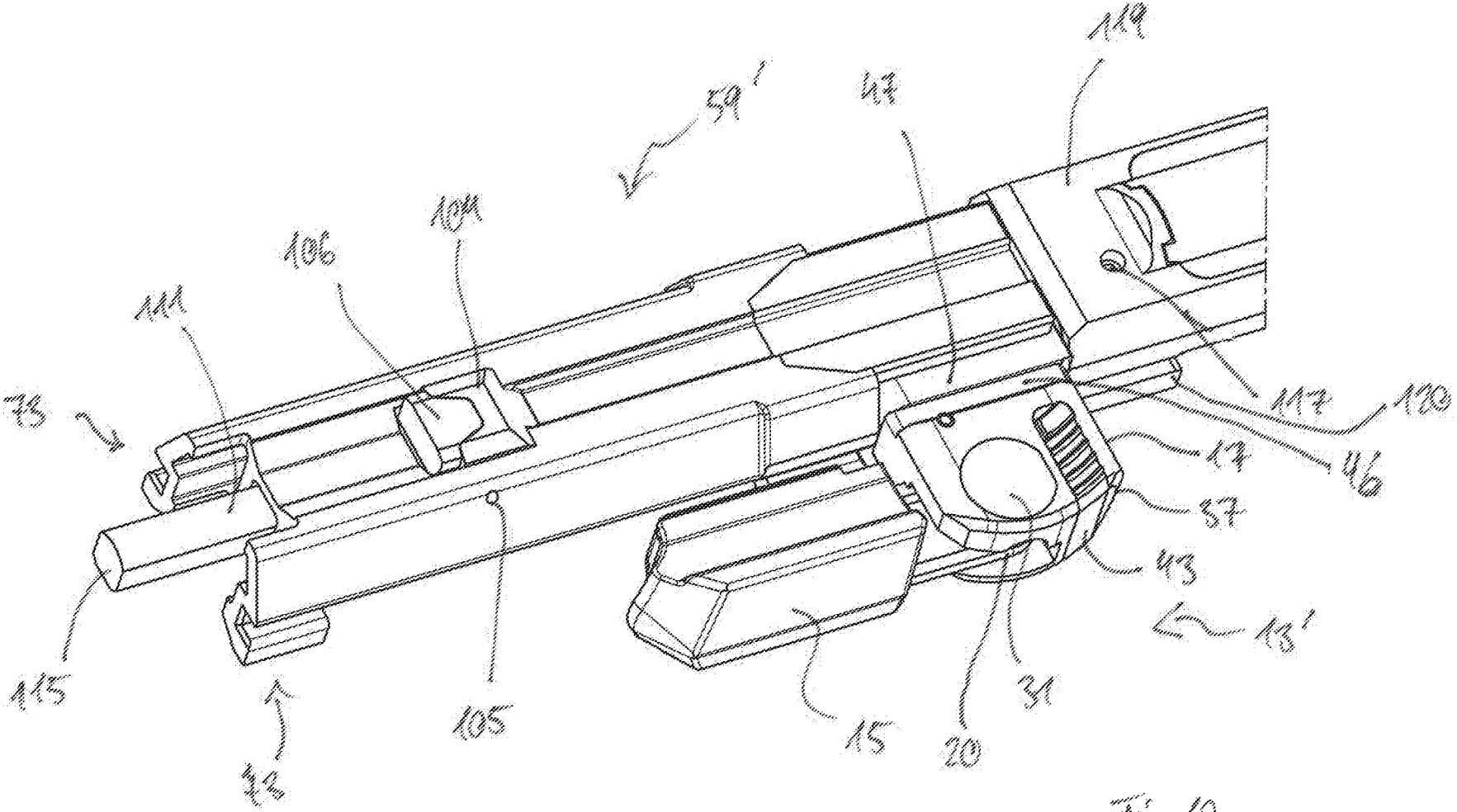
FIG. 10 shows a perspective illustration of the slide or loading lever housing with the loading lever inserted.

FIG. 10 shows a perspective view of the loading lever housing 59' with the loading lever 13' placed therein. The loading lever handle 15 is folded in, where it is latched to the receiver (not shown) with its loading lever latch 23. The loading lever 13' is placed in the bearing 99 of the loading lever housing 59', and the locking pin 51 is held in place, as explained above, such that the disassembly slider 43 is located entirely in the loading lever retainer 17. The loading lever 13 is then in its standby position.

Figure 11:
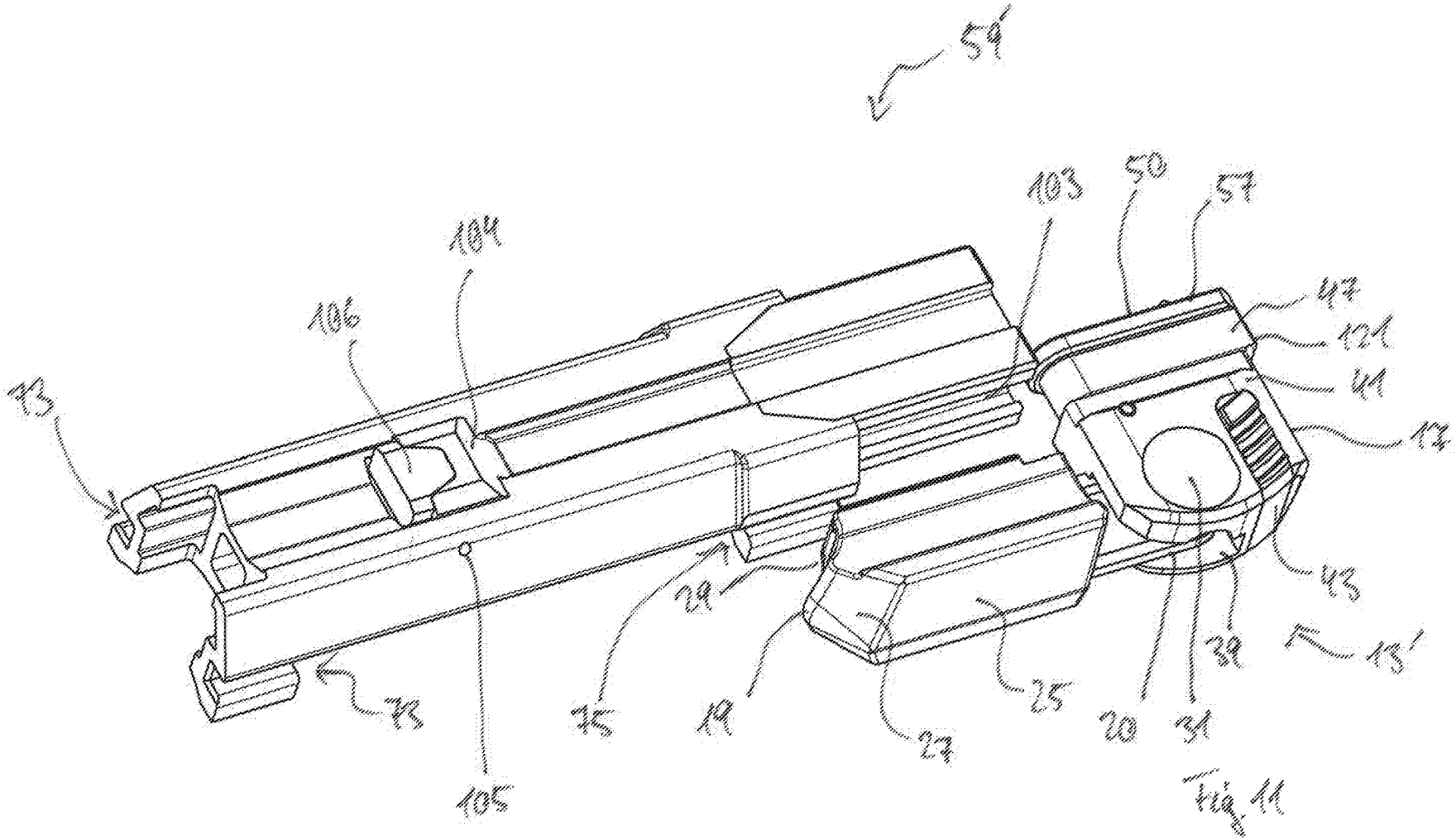
FIG. 11 shows a perspective view of the slide or loading lever housing with the loading lever separated therefrom prior to the coupling.

FIG. 11 shows a perspective view of the loading lever housing 59' with the loading lever 13' removed. The disassembly slider 43 is in its locked position, in which it is inserted into the loading lever retainer 17 and bears thereon. In order to remove it via the disassembly slider 43, as described above, the locking pin 51 is removed from the bore hole 53 counter to the spring force of the locking pin spring or the disassembly slider spring 45 (cf. FIGS. 12 and 13), such that it is disengaged from the locking pin hole 87 in the bearing at its side facing the gas piston rod 111, and ends up basically flush with the end 50 of the loading lever retainer. In the position shown in FIG. 11, the circumferential retention ridge 57 can be inserted into the complementary guide slot 103 on either the left or right side of the loading lever housing 59'. When the loading lever retainer 17 is fully inserted, the locking pin 51 is latched in place in the bearing through the force of the disassembly slider spring 45, and more precisely in the complementary bore hole 87 provided there.

With the loading lever housing 59 of the first embodiment, the locking pin 51 is automatically pushed in, counter to the force of the spring 137, when the loading lever housing 59 is pushed into the bearing 83, and is likewise automatically retained in the bore hole 87 when the loading lever housing 59 strikes the rearmost part of the bearing 83. The disassembly slider 43 needs only to be actuated when the loading lever housing 59 is to be removed.

With the loading lever housing 59' in the second embodiment, the locking pin 51 has a bevel 52 at its latching end (cf. FIG. 8). The disassembly slider 43 does not need to be pulled out to insert the loading lever retainer 17 into the bearing 99. The loading lever housing needs only be pushed into the bearing 99, wherein the locking pin 51 is pushed by the bevel 52 counter to the force of the disassembly slider spring 45, and is automatically latched in place in the bore hole 87 as soon as the loading lever housing 59' strikes the front part of the bearing. The disassembly slider 43 need only be actuated in order to remove the loading lever housing 59'.

Figures 12A, 12B, 12C:
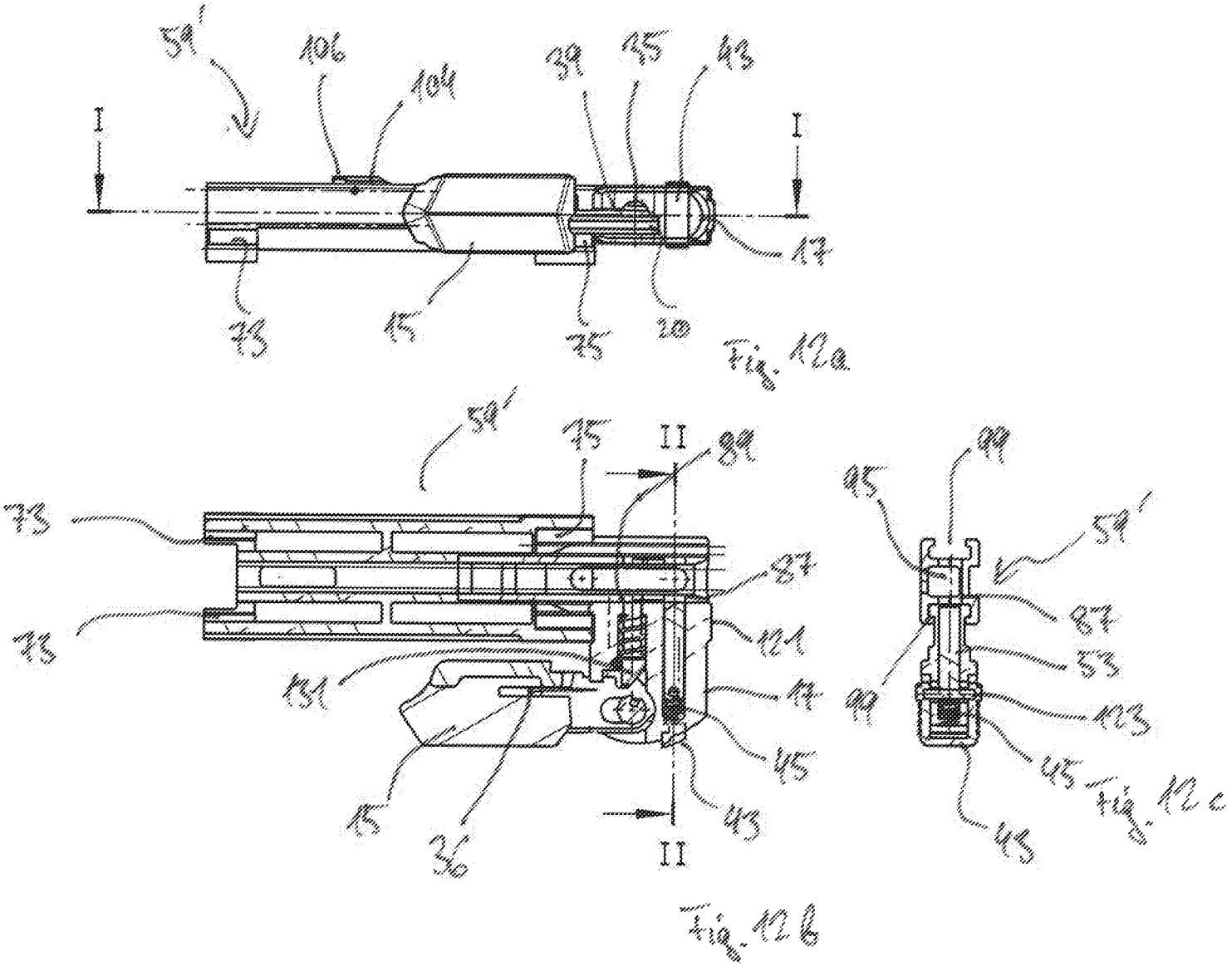
FIG. 12*a* shows a side view of the slide or loading lever housing in FIG. 9 with the loading lever inserted therein.
FIG. 12*b* shows a longitudinal sectional view cut through the slide or loading lever housing in FIG. 12*a*, cut along the cutting plane I-I.
FIG. 12*c* shows a cross section view cut through the slide or loading lever housing in FIG. 12*a* along the cutting plane II-II.

FIGS. 12*a* to 12*c* show the loading lever 13' fully inserted in the left-hand bearing 99, which is then retained in the bearing 99 at a stop, but is not locked in place there. The disassembly slider 43 still extends out of the loading lever retainer 17. The locking pin 51 comprises a bevel 52 at its front end, which faces the bearing 99 (cf. FIG. 8). This beveled surface 52 passes over the contours of the rear guide slot 103 when the loading lever retainer 17 is placed in the bearing 99. When the loading lever retainer 17 is inserted, the bevel 52, and thus the locking pin 51, are pushed toward the locking pin spring, thus compressing it. The locking pin 51 is first forced into the bore hole 81, latching the loading lever 13 in place, when the locking pin 51 is flush with the bore hole 87 in the bearing 99, in its hinging position.

Furthermore, the receiver bearing 36 for the loading lever handle leg of the leg spring that pivots the loading lever handle 15 into the folded-in starting or standby position is shown in the cutting plane I-I depicted in FIG. 12*b*. The leg spring 35 itself is not shown therein. The cross section in FIG. 12*c*, cut along the cutting plane II-II in FIG. 12*b* shows the bearing 99 form on both sides for receiving the loading lever 13'. Furthermore, the cross pin 123 forming a retaining pin for the disassembly slider 43 is depicted.

FIG. 13 shows a further perspective illustration of the loading lever housing 59' without the gas piston rod 111 and with the loading lever 13' placed or slid therein, but not locked in place. The loading lever retainer 17 is inserted fully into the left-hand bearing guide slot 103 of the bearing 99. The disassembly slider 43 protrudes from the loading lever retainer 17 at its outer end, such that the loading lever retainer 17 is not locked in place in the bearing guide slot 103. The right-hand bearing ridge of the bearing 99 is unoccupied.

Figures 14A, 14B, 14C:
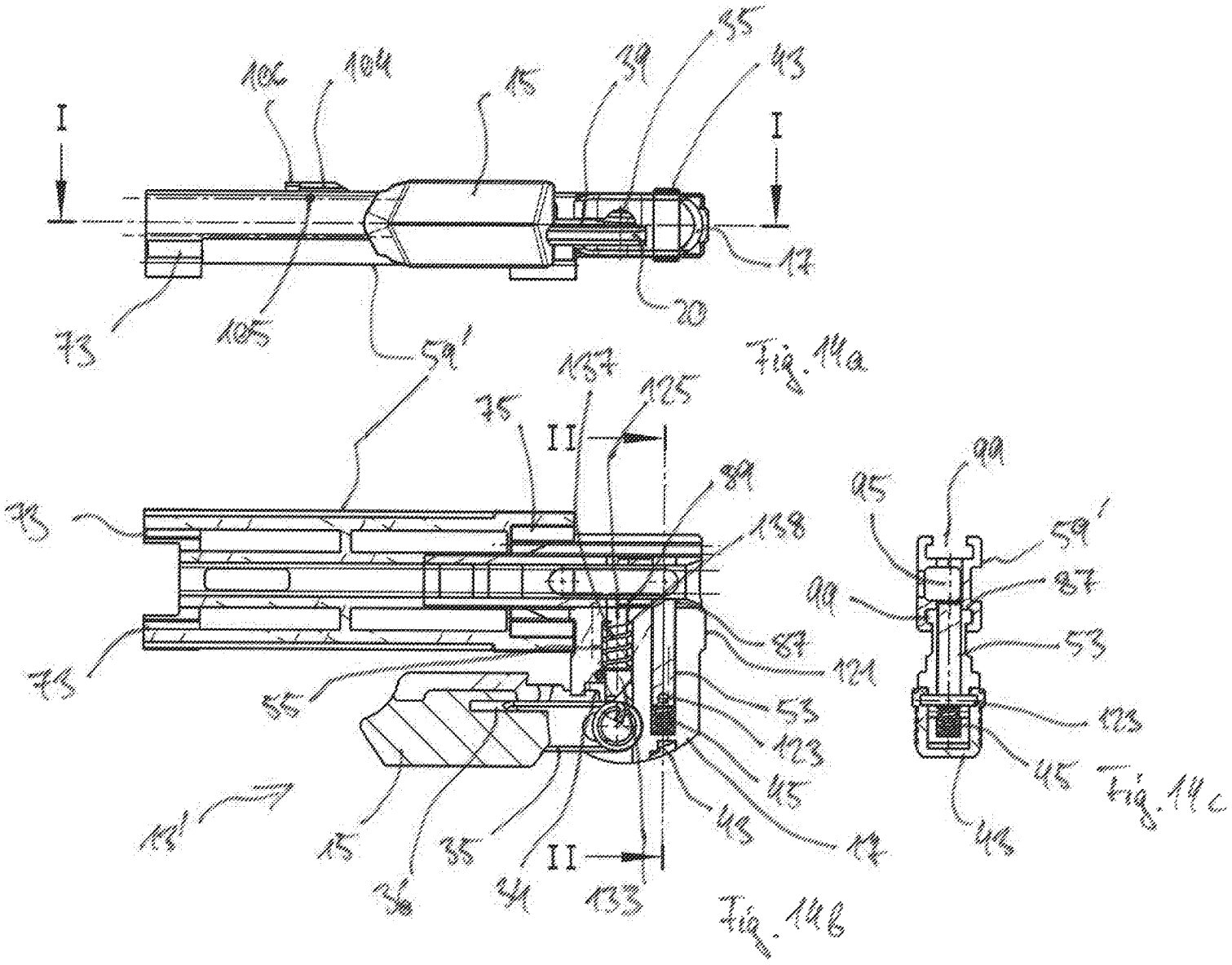
FIG. 14*a* shows a side view of the slide or loading lever housing with the loading lever placed therein and locked in place, from the left.
FIG. 14*b* shows a longitudinal sectional view cut through the slide or loading lever housing in FIG. 14*a* along the cutting plane I-I.
FIG. 14*c* shows a cross section view cut through the slide or loading lever housing in FIG. 14*b* along the cutting plane II-II.
Figure 15:
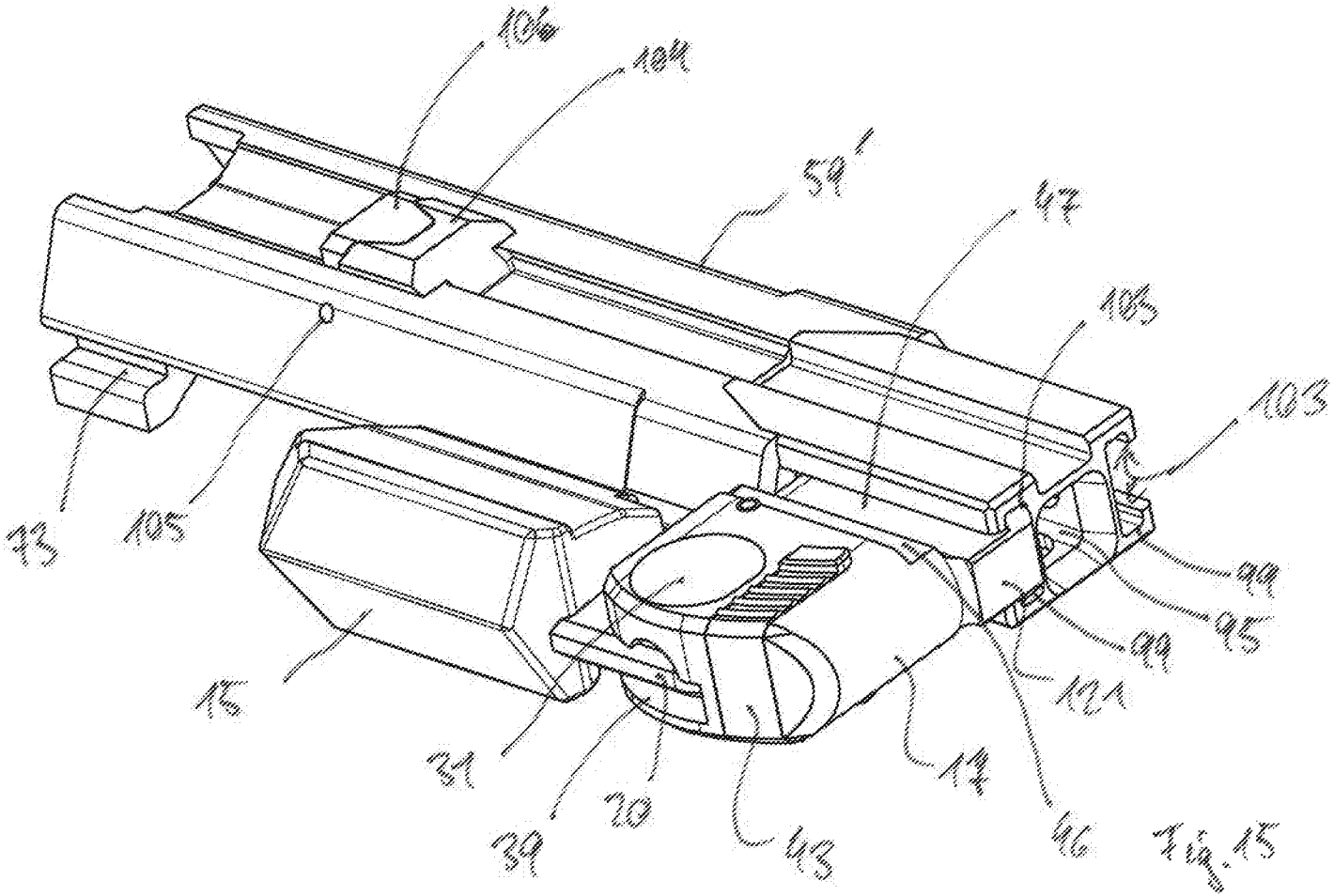

In the side view in FIG. 14*a* and the longitudinal section cut along the cutting plane I-I in FIG. 14*a*, as well as in the cross section in FIG. 14*c* cut along the cutting plane II-II in FIG. 14*b*, the loading lever 13' is shown fully inserted into the bearing 99, and locked in place there. The disassembly slider 43 is entirely inside the loading lever retainer 17, such that the locking pin 51 enters the bore hole 87 in the loading lever housing 59' at its end toward the loading lever housing 59', and is latched in place there. The closing aid pin 125 is not latched in place, and is located outside the bore hole 89. The closing aid pin 107 is braced against its spring bearing 138 in the loading lever retainer 17, specifically in the bore hole 55, and forces the closing aid pin 125 against the inner end 20 of the loading lever handle 15. At this point, the wedge surface 133 on the closing aid pin 125 is located inside the locking latch 34, and thus locks the loading lever 13 in a force fitting manner in its folded-in standby position.

Figure 15:
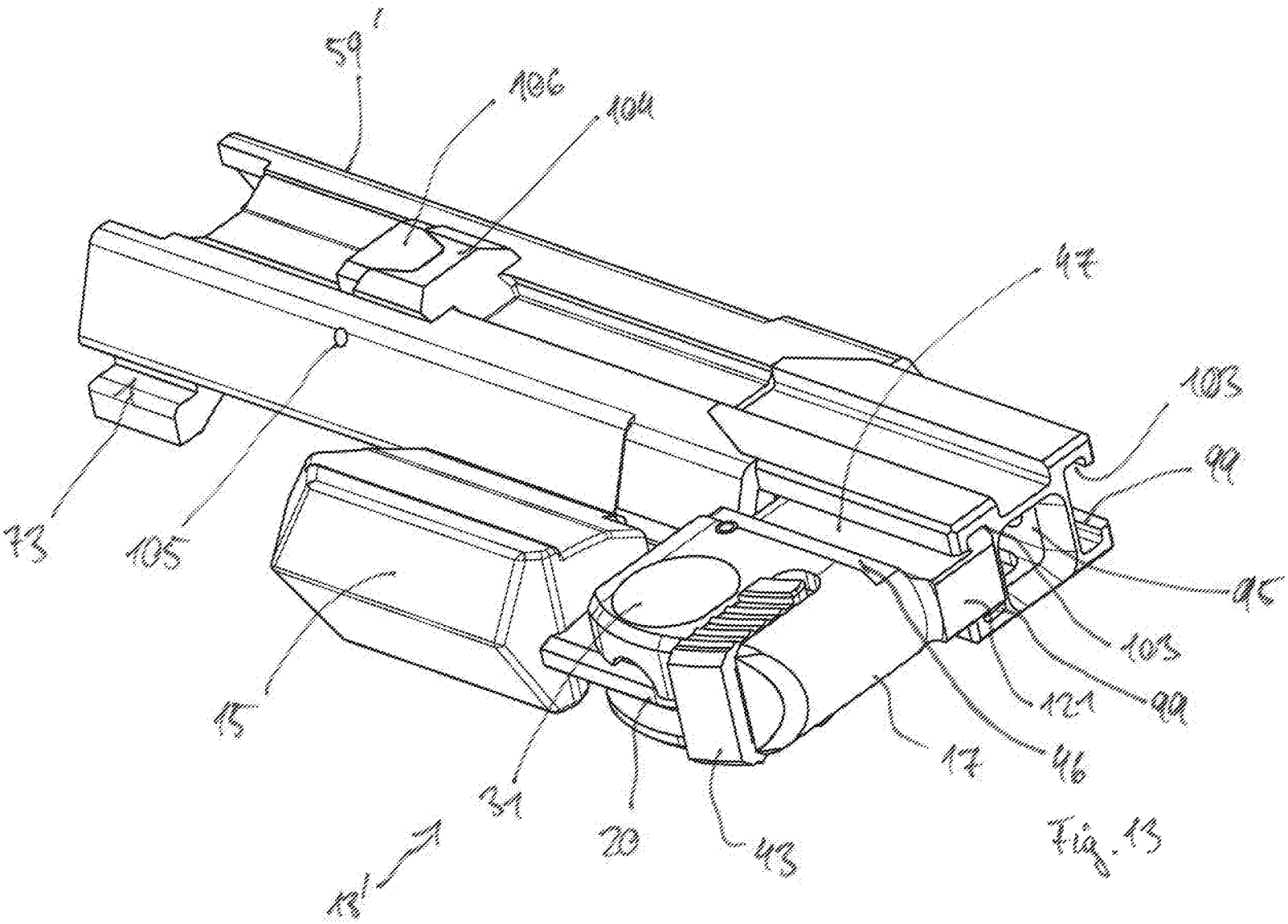
FIG. 15 shows a perspective view of the slide or loading lever housing with the loading lever placed therein and locked in place.

FIG. 15 shows a comparable perspective to the illustration in FIG. 13, in which the disassembly slider 43 is in its locked position, in which the locking pin 51 engages with the bore hole 87 in the bearing 99 on the loading lever housing 59'.

FIGS. 16*a*, 16*b* and 18*a* and 18*b* show components of an automatic firearm, as explained in the introduction, with the chambering device 1 placed therein. FIGS. 17*a*, 17*b* and FIGS. 19*a* and 19*b* show the depictions in FIGS. 16*a*, 16*b* and 18*a*, 18*b*, without the receiver 3.

The barrel 143 comprises a flash suppressor 145 at its front end in each case. A gas discharge 147 is attached to the upper surface of the barrel in the known manner, and supported on the barrel 143 via a locking pin or retaining pin 149. The barrel 143 is reinforced in a section 151 in the region of the gas discharge 147. The barrel transitions toward the back into a chamber 155, into which a cartridge (not shown) is inserted in the known manner via the breechblock head 172.

Two receivers 11 for attaching a grip stock and a hand guard (not shown) are shown in each case on the undersurface of the upper part of the receiver 3.

There is a further receiver 153 at the rear end of the upper part of the receiver 3 for a rear locking pin for a grip stock and breech ring (not shown). The known Picatinny rail 5 is located on the upper surface of the upper part of the receiver 3. The side walls of the upper part of the receiver 3 have guide slots 7 for an ambidextrous attachment of the loading lever 13 with its loading lever handle 15 and loading lever receiver 17. The loading lever handle 15 is secured with its loading lever latch to a counter-retaining element 24 on the receiver in its standby position shown in FIGS. 16*a* to 17*b*.

The chambering device 1 (and thus the loading lever 13) is in its foremost position when in the standby position, in which the buffer 16 on the loading lever housing 59' bears on the fixed stop 109 in the inner surface of the upper part of the receiver 3.

FIGS. 17*a* and 17*b* (without the upper part of the receiver 3) illustrates how the breechblock carrier 119 bears with its upper front end on the loading lever retainer 17, specifically its bearing surface 121 (cf. FIGS. 2*b* and 4*c* to 6*c*). The undersurface of the breechblock carrier 119 bears on the chamber 155, wherein the breechblock head 172 is in its locked position inside the chamber 155. There is a feed regulator pin 157 located inside a feed regulator configuration 158.

A firing pin safety 159 is located at the rear lower end of the breechblock carrier 119. The upper rear end of the breechblock carrier 119 borders on a closing spring 161, which encompasses a closing spring guide tube 163.

Upon firing a round, the breechblock carrier 119 is pushed backward by propellant diverted by the gas discharge 147 acting on the front end of the gas piston rod 111, toward the stock, and decoupled from the loading lever 13 and the loading lever housing 59, 59'. Because the loading lever housing 59, 59' is secured at its starting position on the receiver 3, it does not move therewith. In the rearmost position of the breechblock carrier 119 (cf. FIGS. 18*a* to 19*b*), the closing spring 161 is fully compressed, and the breechblock carrier 119 receives the closing spring guide tube 163, such that the closing spring 161 then forces the breechblock carrier 119 forward.

At the rear end of the closing spring guide tube 163 and the closing spring 161 there is a breech ring 165 in the known manner, which has a retaining pin 167 for coupling to the upper surface of the receiver 3. A known removal handle 169 and a receiver 171 for a housing retaining pin are located on the undersurface of the breech ring 165.

In returning to FIG. 16*a*, the loading lever 13' is located ca. 6 cm further back in the receiver than in the first embodiment. This is due to the different locations of the bearings 99 and 83 (cf. FIGS. 3*a* and 3*b*) on the slides 59 and 59', respectively. Accordingly, the counter-retaining element 24 is also at different locations on the two embodiments.

The chambering of rounds basically simulates a firing of the firearm, but is carried out manually. For this, the loading lever handle 15 is pivoted about 90 degrees to the back (cf. FIGS. 18*a* to 19*a*). The shooter then grips the loading lever handle 15, depending on whether it is located on the left or right side of the firearm, on the left or right side of the firearm, wherein it is unlatched from the counter-retaining element 24 on the receiver 3.

When the loading lever handle 15 is pulled back, it pushes against the back surface of the loading lever housing 59 in the first embodiment, and against the bearing surface 121 on the front surface of the breechblock carrier 119 in the second embodiment. In this manner, it is possible to manually guide the breechblock carrier 119 together with the loading lever handle 15 and the loading lever retainer, as well as the loading lever housing 59' toward the back inside the guide slot 7, counter to the force of the closing spring 161. The breechblock head 172 passes over a magazine (not shown) that is inserted into the automatic firearm in doing so.

Figures 19A, 19B:
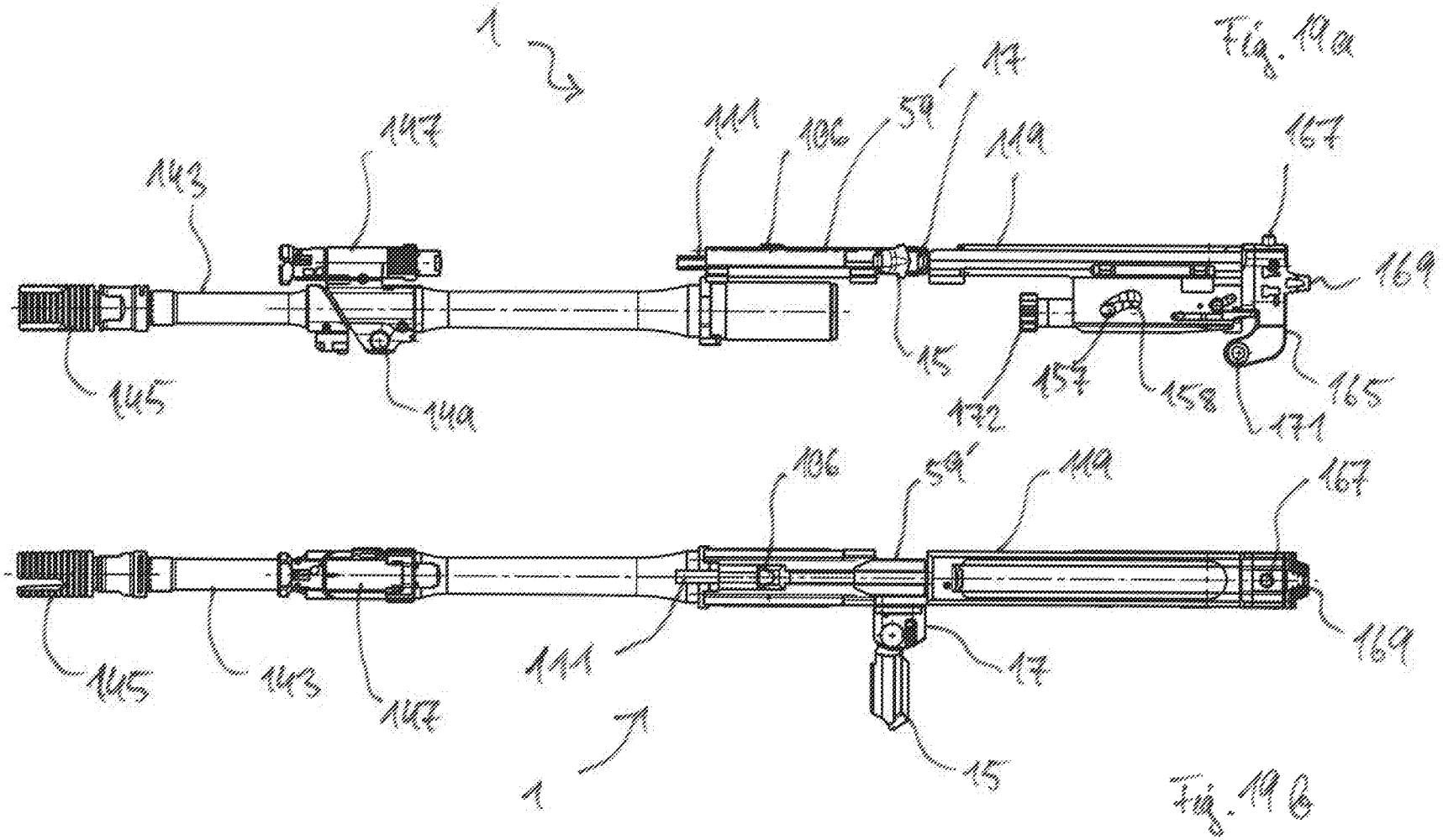
FIG. 19*a* shows an illustration of the chambering device in FIG. 18*a*, without the receiver.
FIG. 19*b* shows a view from above of the illustration in FIG. 19*a;*
Figure 10A:
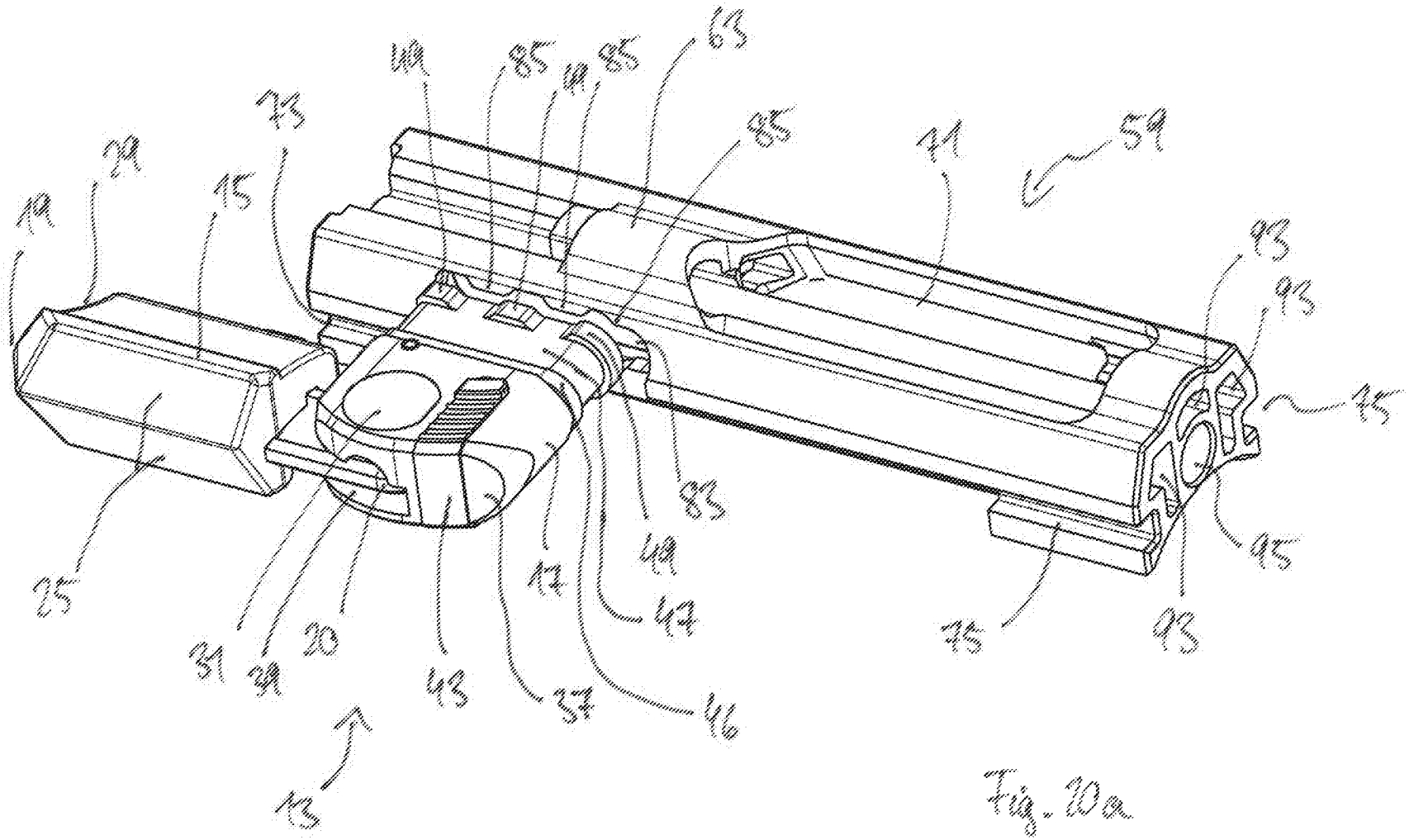
Figure 70B:
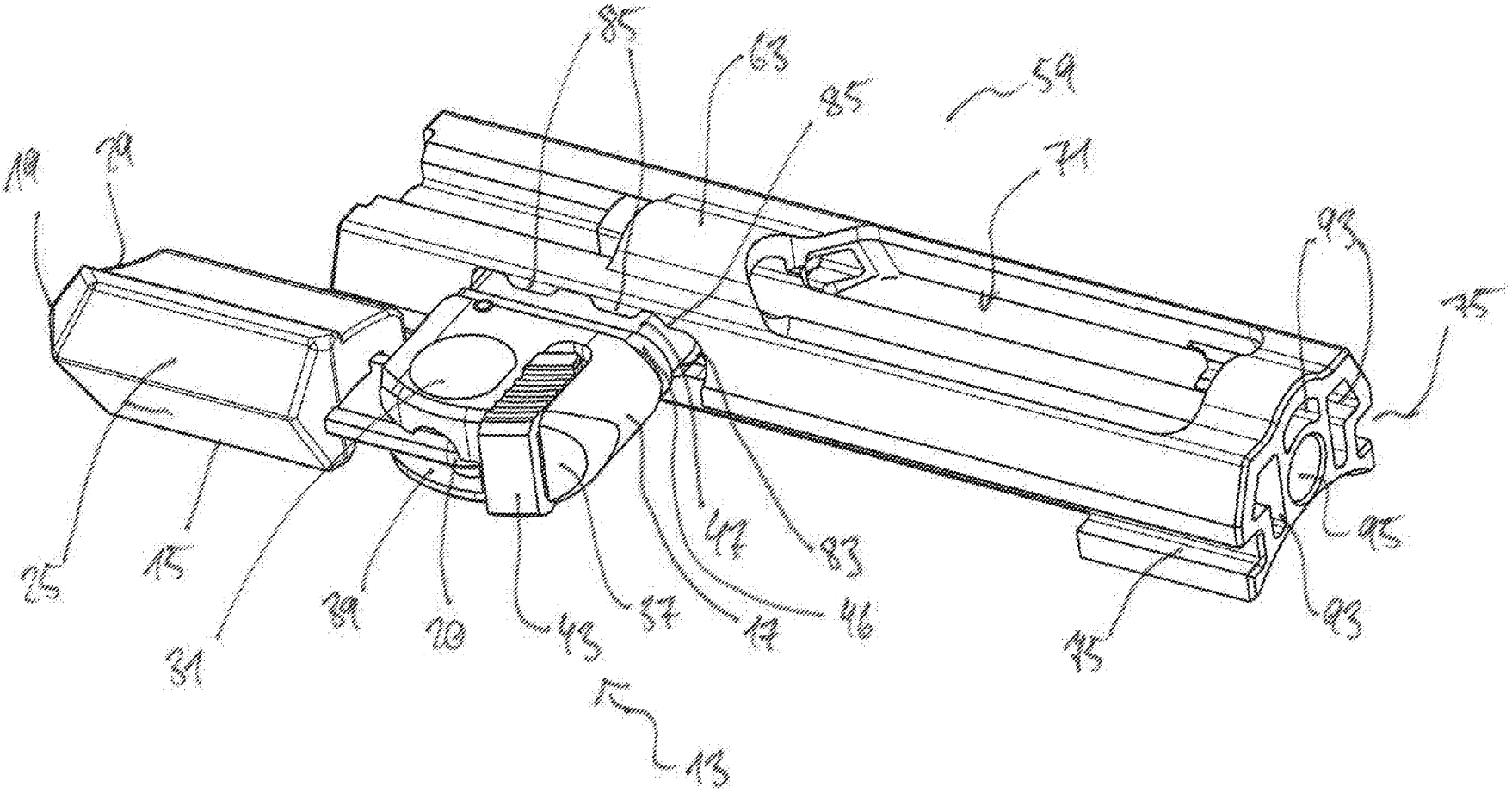
Figure 10C:
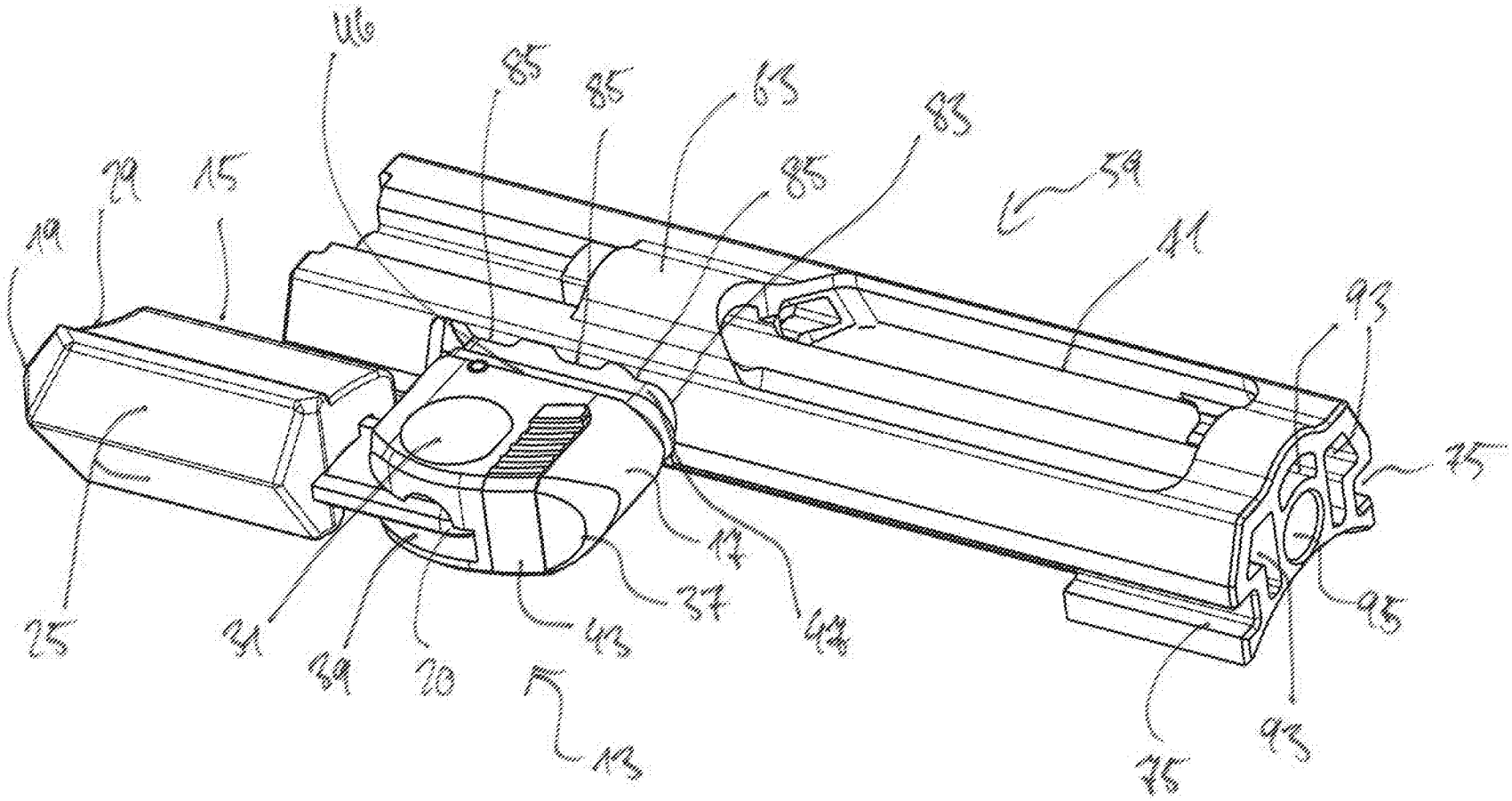

FIGS. 18*a* to 19*b* show the breechblock carrier 119 and the loading lever housing 59' in their rearmost position, in which the breechblock head 172 is also shown in FIG. 19*a*. The feed regulator pin 157 is inside the feed regulator configuration 158 in its foremost position, in which the breechblock head 172 can be unlocked from the chamber 155 and removed therefrom. The locking and unlocking in the feed regulator configuration 158 takes place in the known manner. The closing spring guide tube 161 is received entirely inside the breechblock carrier 119. The front end 115 of the gas piston rod 11 is fully decoupled from the gas discharge 147.

If the chambering position or actuation position of the loading lever 13, 13' shown in FIGS. 18 to 19*b* is manually released, or latched in position toward the front, for a quiet closing thereof, the breechblock head 172 grips, at a front lower end, a cartridge in the magazine, not shown here, and removes it from the magazine, placing it in the chamber 155, wherein the breechblock head 172 is guided in the known manner along the feed regulator configuration 158, and is thus locked inside the chamber 155. The buffer 106 also strikes the fixed stop 109 inside the upper part of the receiver, wherein the closing aid pin 125 is unlatched, such that the loading lever handle 15 is again pivoted forward to its starting or standby position, and is locked in place on the upper part of the receiver 3, in the counter-retaining element formed therein. The firearm is then loaded and ready to fire.

FIGS. 20*a* to 20*c* show further perspective illustrations of the loading lever housing 59 and the loading lever 13 of the first embodiment (cf. FIGS. 2*a* and 3*a*). The loading lever retainer 17 is placed in the bearing 83 of the loading lever housing 59 in FIG. 20*a*. The retaining lugs 49 face the recesses between the retaining lugs 85 in the bearing 83 of the loading lever housing 59 at this point. The retaining lugs 85 on the bearing 83 collectively form a bearing configuration. In this position, the loading lever 13 can be placed in the bearing 83, or removed therefrom. The disassembly slider 43 is in its locked position in FIG. 20*a*, and is thus fully inserted in the loading lever retainer 17. The locking pin 51 (cf. FIG. 2*a*) protrudes from the undersurface of the loading lever retainer 17.

The disassembly slider 43 is pushed out of the loading lever retainer 17 in FIG. 20*b*, such that the locking pin 51 is inserted into the undersurface of the loading lever retainer 17. In this position, the undersurface of the loading lever retainer 17 bears entirely on the upper surface of the bearing 83.

The locking of the loading lever retainer 17 is illustrated in FIG. 20*c*. In comparison to FIG. 20*b*, the loading lever retainer 17 is pushed back, such that it bears on the stop on the outer end of the bearing configuration. In this position, the locking pin is above the associated complementary bore hole 87 inside the bearing 82 of the loading lever housing 59 (cf. FIG. 2*a*), and can enter this hole, wherein the disassembly slider 43 is again flush with the outer surface 37 of the loading lever retainer 17. When the loading lever retainer 17 is slid back inside the loading lever housing 59, the retaining lugs 49 are displaced in relation to the bearing configuration and the retaining lugs 85, and latch in place there. The loading lever 13 is thus secured in the bearing 82.

Figure 21:
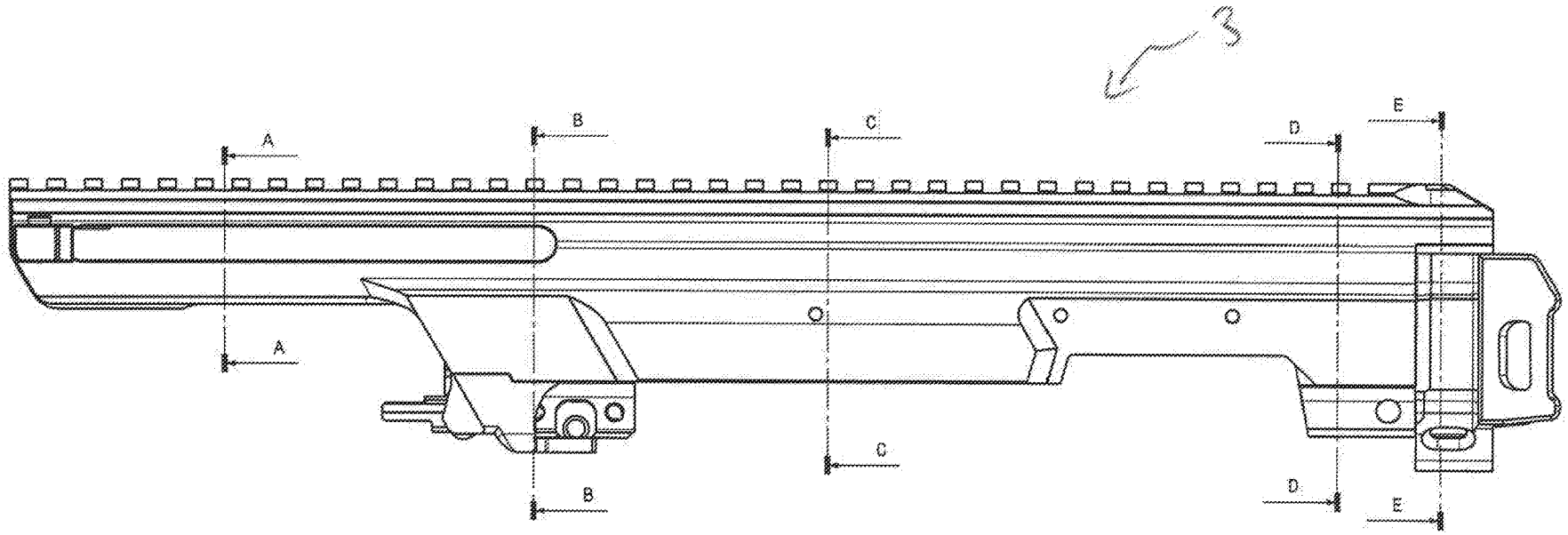
FIG. 21 shows a side view of a receiver for the HK433 by the same applicant.
Figure 22A:
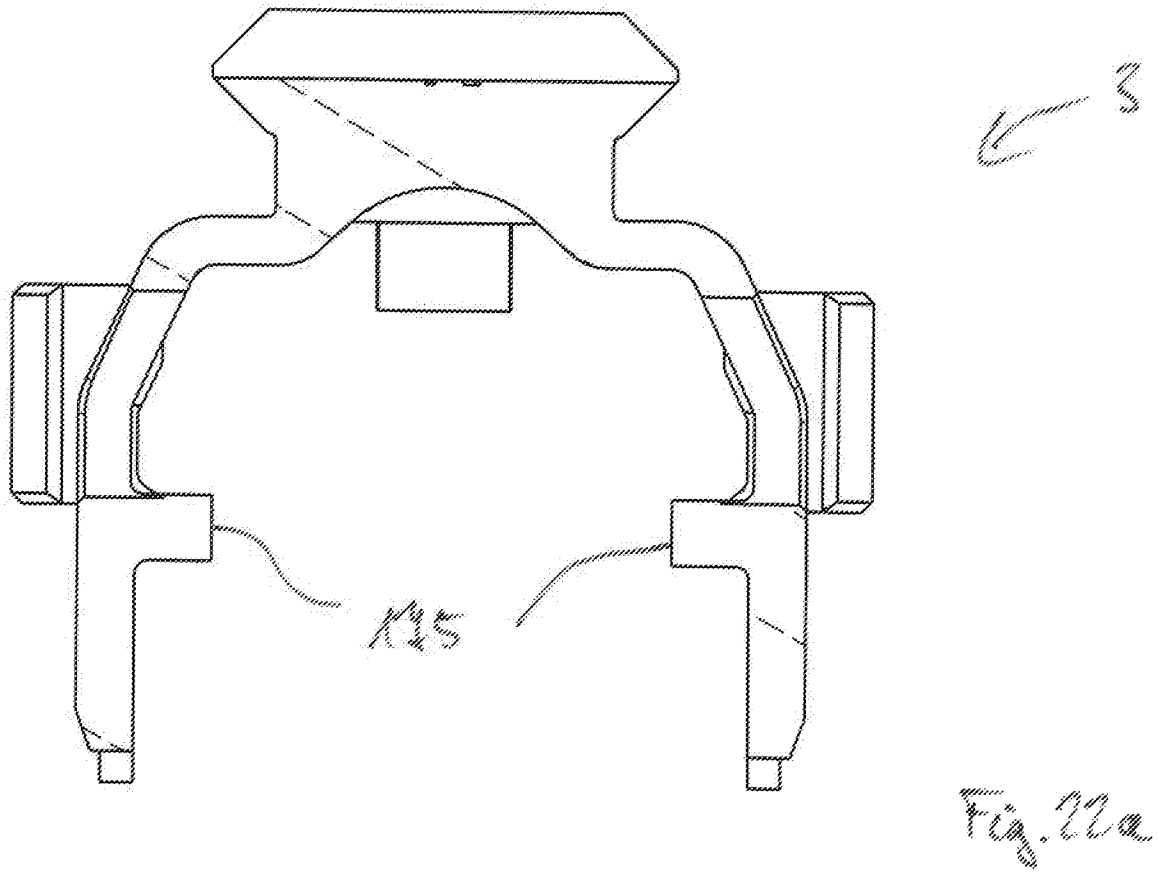
FIG. 22*a* shows a cross section cut through the receiver in FIG. 21 along the cutting plane A-A.
Figure 22B:
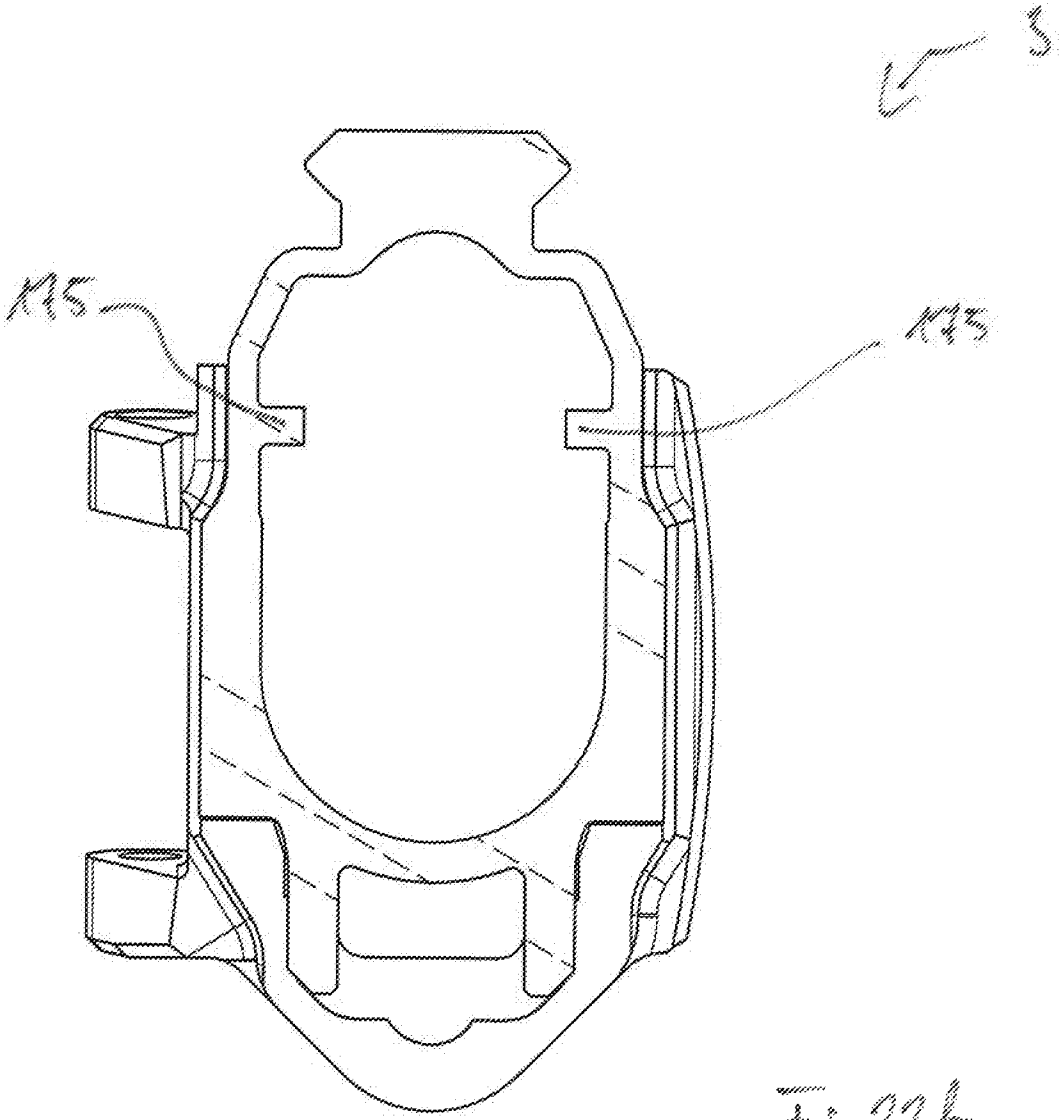
FIG. 22*b* shows a cross section cut through the receiver in FIG. 21 along the cutting plane E-E.

FIG. 21 shows a side view of the receiver of the assault rifle HK433 by the same applicant, from a parallel application, DE 10 2017 002 242.9. FIGS. 22*a* and 22*b* each show cross sections cut through the receiver in FIG. 21 along the cutting planes A-A and E-E. The details of this receiver are described in DE 10 2017 002 242.9.

The breechblock guide rails 175 are formed in the receiver 3 on both sides in the middle, and extend to engage with guide grooves on both sides of the breechblock carrier guide 120 on the upper surface of the breechblock carrier 119, and with the front and rear loading lever housing guides 73 and 75, at a right angle toward the inside. The breechblock guide rails 175 are formed as an integral part of the monolithic receiver over the entire length of the receiver, during the extrusion or molding of the receiver 3. The breechblock guide rails 175 form a rail guide for the breechblock carrier 119 as well as for the loading lever housing, or slide 59, 59'.

Because of this loading lever housing guidance, the loading lever can be located relatively far back in the firearm, thus improving the ergonomic manipulation of the chambering device 1.

Further embodiments of the invention can be derived by the person skilled in the art from the following claims and the attached drawings.

Example methods, apparatus, systems, and articles of manufacture to Device for Chambering of Rounds in an Automatic Firearm, and an Automatic Firearm Equipped with the Same are disclosed herein. Further examples and combinations thereof include the following:

Example 1 includes a device for chambering rounds in an automatic firearm having a breech that can move longitudinally in a receiver, the device comprising a chambering lever including a charging handle coupled to a handle retainer, and a slide having a left side and a right side, the slide movable longitudinally in the receiver, wherein the charging handle is pivotable from a standby position to an actuation position relative to the handle retainer, and wherein the handle retainer can be mounted to the left side or the right side the slide and can be removed therefrom without tools.

Example 2 includes the device according to example 1, wherein the charging handle is pretensioned on the handle retainer when in the standby position.

Example 3 includes the device according to example 1 or 2, wherein when chambering a round in the automatic firearm, only one bearing surface of the handle retainer or one end surface of the slide is releasably connected to the breech.

Example 4 includes the device according to any of examples 1-3, wherein when firing the automatic firearm, the device is entirely separated from the breech.

Example 5 includes the device according to any of examples 1-4, wherein at the bolt includes a latching element that is configured to latch onto or with a counter-latch on the receiver, such that the bolt can be secured to the counter-latch.

Example 6 includes the device according to any of examples 1-5, wherein the slide includes at least one longitudinal hole to receive a gas piston rod.

Example 7 includes the device according to any of examples 1-6, wherein the device can be secured to the gas piston rod for loading a cartridge into a chamber.

Example 8 includes the device according to example 7, wherein the device has an engagement element that engages with at least one hole in the gas piston rod, wherein the engagement element can be moved between an engaged position and a released position.

Example 9 includes the device according to example 8, wherein the engagement element is pretensioned in its released position via an elastic element.

Example 10 includes the device according to example 8 or 9, wherein the charging handle can only be slid and/or pivoted into its engaged position when the handle retainer is in the actuation position.

Example 11 includes the device according to any of examples 1-10, wherein the charging handle is hinged at an end facing the slide such that the charging handle can pivot about a bearing axle in the handle retainer between the standby position and the actuation position, and the bold handle includes an elongated hole that encompasses the bearing axle and extends in a direction substantially transverse to the longitudinal direction of the device when the charging handle is in the actuation position.

Example 12 includes the device according to example 11, wherein the charging handle is pivotable about an end of the elongated hole facing the slide when pivoted between the standby position and the actuation position, and can be displaced when the charging handle is brought into the engaged position inside the elongated hole such that the bearing axle bears on an end of the elongated hole lying opposite the slide.

Example 13 includes the device according to example 12, wherein the charging handle includes a locking latch at an end facing the slide that engages with the engagement element when in the standby position, wherein the locking latch is disengaged from the engagement element when the charging handle is pivoted into the actuation position, and pivots and/or slides the engagement element toward the slide.

Example 14 includes the device according to any of examples 1-13, wherein the slide has a receiver bearing for receiving and coupling the handle retainer.

Example 15 includes the device according to any of examples 1-14, wherein the handle retainer can be locked in place on the slide in or on the receiver bearing.

Example 16 includes the device according to any of examples 1-15, wherein the handle retainer has a spring-loaded element, the actuation of which to a disassembly position unlatches the handle retainer from the slide.

Example 17 includes the device according to any of examples 1-16, wherein the slide comprises a guide section on each side thereof, in which complementary guide rails engage and are guided in the receiver.

Example 18 includes the device according to any of examples 1-17, wherein the slide includes a stop element with a buffer element that strikes a fixed stop in the receiver.

Example 19 includes an automatic firearm including a bolt action for chambering rounds and a breech that can move longitudinally in a receiver, the automatic firearm comprising a chambering lever including a charging handle coupled to a bolt retainer, and a slide having a left side and a right side, the slide movable longitudinally in the receiver, wherein the charging handle is pivotable from a standby position to an actuation position relative to the bolt retainer, and wherein the handle retainer can be mounted to the left side or the right side the slide and can be removed therefrom without tools.

Example 20 includes the automatic firearm according to example 19, wherein the receiver includes guide rails extending on both longitudinal sides of the receiver for guiding the breechblock carrier via guide sections on both sides of the breechblock carrier, and for guiding the slide via its guide sections formed on each side thereof.

Example 21 includes the automatic firearm according to example 19 or 20, wherein the receiver includes a hole on a side of the receiver, through which the handle retainer coupled to the charging handle can be placed in or removed from the slide for assembly or disassembly, respectively, and in which it is guided during the chambering procedure.

Example 22 includes the automatic firearm according to any of examples 19-21, wherein the receiver includes a counter-latch on the receiver, which can be secured in place on the bolt lever during the movement of the breech.

LIST OF REFERENCE SYMBOLS

1 chambering device
3 receiver
5 Picatinny rail
6 mounting screw for a fixed stop 109 in the receiver
7 guide slot
9 undersurface
11 receivers for the handle and hand guard attachments
13, 13' loading lever
15 loading lever handle
17 loading lever retainer
19 outer end of the loading lever handle
20 inner end of the loading lever handle
21 liner
22 inner loading lever handle
23 retaining lug/loading lever latch
24 counter-retaining element on receiver
25 outer slanted surface
27 front slanted surface
29 rounded undersurface
31 loading lever axle
33 oblong hole in inner end of the loading lever handle 20
34 locking latch for the recoil spring in the standby position
35 spring
36 receiver bearing for the loading lever handle leg of the spring 35
37 outer surface of the loading lever retainer 17
39 slot in the outer surface
40 stop
41 surface
43 disassembly slider
44 profile structure on 43
45 disassembly slider spring
46 guide surface
47 circumferential recess in the upper surface and lateral surfaces
49 retaining lug
50 end/undersurface of the loading lever retainer
51 locking pin for the disassembly slider
52 bevel on locking pin
53 bore hole for the locking pin in the disassembly slider
55 bore hole for the closing pin for securing it to the gas piston
57 retention ridge (continuous)
59, 59' loading lever housing/loading lever housing
61 upper surface
63 front ridge
67 buffered stop
69 rear ridge
71 front recess
73 front loading lever housing guide
75 rear loading lever housing guide
77 upper guide section
79 lower guide section
83 bearing for loading lever retainer
85 retaining lugs in bearing
87 bore hole for locking pin
89 through hole for closing pin

91 slanted lateral surfaces
93 recesses in loading lever housing (weight reducing)
95 gas piston rode receiver
97 semicircular undersurface
98 section
99 bearing for loading lever retainer
101 rear end of loading lever housing 59'
103 parallel guide slot
104 buffer bearing of the buffered stop
105 cross pin bearing for rubber buffer
106 rubber buffer
107 recessed region between loading lever housing guides 73' and 75'
109 fixed stop in receiver
111 gas piston rod
113 rear end of gas piston rod
115 front end of gas piston rod
117 cross pin for securing 113
119 breechblock carrier
120 loading lever housing guide on breechblock carrier
121 bearing surface of loading lever retainer 17 on breechblock carrier
123 bearing pin as a spring bearing for closing pin and disassembly slider
124 bearing
125 closing pin
127 closing pin recesses on both sides of gas piston rod
129 inner end of locking pin
131 wedge-shaped end of closing pin
133 wedge surface/latch on locking pin for engagement with 34
137 spring for closing pin
138 spring bearing for 137
139 locking surface for loading lever
141 stop and locking pin for closing pin
143 barrel
145 flash suppressor
147 gas discharge
149 limit pin/retaining pin for 147
151 reinforced barrel section
153 receiver for rear limit pin for handle and breech ring
155 cartridge chamber
157 feed regulator pin
158 feed regulator configuration
159 firing pin safety
161 closing spring
163 closing spring guide tube
165 breech ring
167 retaining pin for upper loading lever housing surface
169 removal handle on 165
171 receiver for the receiver retaining pin
172 breechblock head
175 guide rail

The invention claimed is:

1. A chambering device for an automatic firearm having a breechblock that can move longitudinally in a receiver, the chambering device comprising:

a loading lever including a loading lever handle coupled to a loading lever retainer, a loading lever housing that can move longitudinally in the receiver, and a retaining element on the loading lever, wherein the retaining element is configured to latch onto or with a counter-retaining element on the receiver, such that the loading lever can be secured to the counter-retaining element, wherein the loading lever handle can be pivoted from a standby position to an actuation position and back in the loading lever retainer, the loading lever retainer can be selectively mounted in or on the left and/or right side of the loading lever housing and can be removed therefrom without tools.

2. The chambering device according to claim 1, characterized in that the loading lever handle is pretensioned on the loading lever retainer when in its standby position.

3. The chambering device according to claim 1, wherein when chambering a round in the automatic firearm, only one bearing surface of the loading lever retainer and/or one end surface of the loading lever housing is releasably connected to the breechblock.

4. The chambering device according to claim 1, wherein when firing the automatic firearm, the chambering device is entirely separated from the breechblock.

5. The chambering device according to claim 1, wherein at least one longitudinal hole passes through the loading lever housing, provided in particular for receiving a gas piston rod.

6. The chambering device according to claim 1, wherein the chambering device can be secured to the automatic firearm, in particular the gas piston rod for loading a cartridge into a chamber.

7. The chambering device according to claim 6, wherein the chambering device has an engagement element that engages with at least one recess in the gas piston rod, wherein the engagement element can be moved between an engaged position and a released position.

8. The chambering device according to claim 7, wherein the engagement element is pretensioned in its released position via an elastic element.

9. The chambering device according to claim 7, wherein the loading lever handle can only be slid and/or pivoted into its engaged position when the loading lever retainer is in the actuation position.

10. The chambering device according to claim 1, wherein the loading lever handle is hinged at its end facing the loading lever housing such that it can pivot about a bearing axle in the loading lever retainer between its standby position and it actuation position, and has an oblong hole for this in particular, which encompasses the bearing axle and extends basically transverse to the longitudinal direction of the chambering device when in the actuation position.

11. The chambering device according to claim 10, wherein the loading lever handle can pivot about the end of the oblong hole facing the loading lever housing when pivoted between its standby position and its actuation position, and can be displaced when the loading lever handle is brought into its engaged position inside the oblong hole such that the bearing axle bears on the end of the oblong hole lying opposite the loading lever housing.

12. The chambering device according to claim 11, wherein the loading lever handle comprises a locking latch at its end facing the loading lever housing that engages with the engagement element when in the standby position, wherein the locking latch is disengaged from the engagement element when the loading lever handle is pivoted into the actuation position, and pivots and/or slides the engagement element toward the loading lever housing.

13. The chambering device according to claim 1, wherein the loading lever housing has at least one receiver bearing for receiving and coupling the loading lever retainer.

14. The chambering device according to claim 1, wherein the loading lever retainer can be locked in place on the loading lever housing, in particular in or on the receiver bearing.

15. The chambering device according to claim 1, wherein the loading lever retainer has a spring-loaded disassembly element, the actuation of which to a disassembly position unlatches the loading lever retainer from the loading lever housing.

16. The chambering device according to claim 1, wherein the loading lever housing comprises at least one guide section on each side, in which complementary guide rails engage and are guided in the receiver.

17. The chambering device according claim 1, wherein a stop element with a buffer element that strikes a fixed stop in the receiver is provided on the loading lever housing.

18. An automatic firearm, including a chambering device having a breechblock that can move longitudinally in a receiver, the automatic firearm comprising:

a loading lever including a loading lever handle coupled to a loading lever retainer, a loading lever housing that can move longitudinally in the receiver, and a retaining element on the loading lever, wherein the retaining element is configured to latch onto or with a counter-retaining element on the receiver, such that the loading lever can be secured to the counter-retaining element, wherein the loading lever handle can be pivoted from a standby position to an actuation position and back in the loading lever retainer, the loading lever retainer can be selectively mounted in or on the left and/or right side of the loading lever housing and can be removed therefrom without tools.

19. The automatic firearm according to claim 18, wherein there are guide rails extending on both longitudinal sides of the receiver for guiding the breechblock carrier via guide sections on both sides of the breechblock carrier, and for guiding the loading lever housing via its guide sections formed on each side thereof.

20. The automatic firearm according to claim 18, wherein there is a hole on at least one side of the receiver, through which the loading lever retainer coupled to the loading lever handle can be placed in or removed from the loading lever housing for assembly or disassembly, respectively, and in which it is guided during the chambering procedure.

21. The automatic firearm according to claim 18, wherein the counter-retaining element on the receiver can be secured in place on the loading lever during the movement of the breechblock.

* * * * *